US010557308B2

(12) United States Patent
Russell

(10) Patent No.: US 10,557,308 B2
(45) Date of Patent: Feb. 11, 2020

(54) PROJECTILE DRILLING SYSTEM

(71) Applicant: HYPERSCIENCES, INC., Spokane, WA (US)

(72) Inventor: Mark C. Russell, Spokane, WA (US)

(73) Assignee: HYPERSCIENCES, INC., Spokane, WA (US)

( * ) Notice: Subject to any disclaimer, the term of this patent is extended or adjusted under 35 U.S.C. 154(b) by 0 days.

(21) Appl. No.: 15/340,753

(22) Filed: Nov. 1, 2016

(65) Prior Publication Data

US 2017/0130531 A1 May 11, 2017

Related U.S. Application Data

(60) Provisional application No. 62/255,161, filed on Nov. 13, 2015, provisional application No. 62/253,228, filed on Nov. 10, 2015.

(51) Int. Cl.

| | |
|---|---|
| ***E21B 7/16*** | (2006.01) |
| ***E21B 7/18*** | (2006.01) |
| ***E21B 7/00*** | (2006.01) |
| ***F41A 1/04*** | (2006.01) |
| ***E21C 37/00*** | (2006.01) |
| ***F41A 1/02*** | (2006.01) |

(Continued)

(52) U.S. Cl.

CPC ..... *E21B 7/007* (2013.01); *E21B 7/16* (2013.01); *E21B 7/18* (2013.01); *E21B 17/18* (2013.01); *E21B 33/14* (2013.01); *E21C 37/005* (2013.01); *F41A 1/02* (2013.01); *F41A 1/04* (2013.01); *F42B 12/06* (2013.01); *F42B 12/74* (2013.01); *F42D 3/04* (2013.01)

(58) Field of Classification Search

CPC ... E21B 7/007; E21B 7/16; E21B 7/18; E21B 7/1245; E21C 37/005

See application file for complete search history.

(56) References Cited

U.S. PATENT DOCUMENTS

| | | | |
|---|---|---|---|
| 2,544,573 | A | 3/1951 | Vincent |
| 2,621,732 | A | 12/1952 | Ahlgren |

(Continued)

FOREIGN PATENT DOCUMENTS

| | | | |
|---|---|---|---|
| CN | 101017076 | A | 8/2007 |
| CN | 101099024 | A | 1/2008 |

(Continued)

OTHER PUBLICATIONS

Wittman-Regis, Agnes, "Patent Cooperation Treaty International Preliminary Report on Patentability dated Mar. 12, 2019", Patent Cooperation Treaty Application No. PCT/US2017/050736, Patent Cooperation Treaty, Mar. 12, 2019.

(Continued)

*Primary Examiner* — Cathleen R Hutchins

(74) *Attorney, Agent, or Firm* — Lindauer Law, PLLC

(57) ABSTRACT

A hole in geologic material, such as a wellbore, may be extended by impacting the working face of the hole with high velocity projectiles. A tube may be placed within the hole, and the lower end of the tube may be sealed to prevent ingress of material from the hole into the tube. A projectile may be accelerated through the tube, such as by igniting a combustible gas mixture to impart a force to the projectile. The impact of the projectile may extend the hole. In some cases, accelerated projectiles may be used in conjunction with a drill bit to drill a wellbore or other type of hole.

20 Claims, 16 Drawing Sheets

(51) Int. Cl.

| | |
|---|---|
| ***F42B 12/06*** | (2006.01) |
| ***F42B 12/74*** | (2006.01) |
| ***F42D 3/04*** | (2006.01) |
| ***E21B 33/14*** | (2006.01) |
| ***E21B 17/18*** | (2006.01) |

(56) References Cited

U.S. PATENT DOCUMENTS

| | | | |
|---|---|---|---|
| 2,913,959 | A | 11/1959 | Mohaupt |
| 3,075,463 | A | 1/1963 | Eilers et al. |
| 3,185,224 | A | 5/1965 | Robinson, Jr. |
| 3,190,372 | A | 6/1965 | Johnson |
| 3,244,232 | A | 4/1966 | Myers |
| 3,253,511 | A | 5/1966 | Zwicky |
| 3,441,095 | A | 4/1969 | Youmans |
| 3,633,686 | A | 1/1972 | Bennett |
| 3,695,715 | A | 10/1972 | Godfrey |
| 3,863,723 | A | 2/1975 | Godfrey |
| 3,867,867 | A | 2/1975 | Duff |
| 4,004,642 | A | 1/1977 | Dardick |
| 4,030,557 | A | 6/1977 | Alvis et al. |
| 4,063,486 | A | 12/1977 | Ashley |
| 4,123,975 | A | 11/1978 | Mohaupt |
| 4,158,388 | A | 6/1979 | Owen et al. |
| 4,467,878 | A | 8/1984 | Ibsen |
| 4,582,147 | A | 4/1986 | Dardick |
| 4,638,712 | A | 1/1987 | Chawla et al. |
| 4,679,637 | A | 7/1987 | Cherrington et al. |
| 4,722,261 | A | 2/1988 | Titus |
| 4,791,850 | A | 12/1988 | Minovitch |
| 4,907,488 | A | 3/1990 | Seberger |
| 4,932,306 | A | 6/1990 | Rom |
| 4,982,647 | A | 1/1991 | Hertzberg et al. |
| 5,063,826 | A | 11/1991 | Bulman |
| 5,097,743 | A | 3/1992 | Hertzberg et al. |
| 5,098,163 | A | 3/1992 | Young, III |
| 5,233,903 | A | 8/1993 | Saphier et al. |
| 5,421,237 | A | 6/1995 | Naumann |
| 5,487,405 | A | 1/1996 | Skoglund |
| 5,574,244 | A | 11/1996 | Powell et al. |
| 5,578,783 | A | 11/1996 | Brandeis |
| 5,768,940 | A | 6/1998 | Kawaguchi et al. |
| 5,833,003 | A | 11/1998 | Longbottom et al. |
| 5,996,709 | A | 12/1999 | Norris |
| 6,000,479 | A | 12/1999 | Ambs |
| 6,035,784 | A | 3/2000 | Watson |
| 6,457,417 | B1 | 10/2002 | Beal |
| 6,467,387 | B1 | 10/2002 | Espinosa et al. |
| 6,591,731 | B2 | 7/2003 | Goldstein |
| 7,069,862 | B2 | 7/2006 | Bassett |
| 7,681,352 | B2 | 3/2010 | Fu et al. |
| 7,942,481 | B2 | 5/2011 | Leppanen |
| 8,181,561 | B2 | 5/2012 | Riggs et al. |
| 8,302,584 | B1 | 11/2012 | Lu |
| 8,943,970 | B2 | 2/2015 | Greeley et al. |
| 9,103,624 | B1 | 8/2015 | Kung et al. |
| 9,169,695 | B1 | 10/2015 | Calvert |
| 9,540,895 | B2 | 1/2017 | MacKenzie et al. |
| 2002/0100361 | A1 | 8/2002 | Russell |
| 2005/0034896 | A1 | 2/2005 | Youan |
| 2007/0044963 | A1 | 3/2007 | MacDougall |
| 2007/0186761 | A1 | 8/2007 | Perry |
| 2007/0256826 | A1 | 11/2007 | Ceccarelli et al. |
| 2008/0205191 | A1 | 8/2008 | Coste et al. |
| 2009/0322185 | A1 | 12/2009 | Barnard et al. |
| 2010/0032206 | A1 | 2/2010 | Becker et al. |
| 2010/0133006 | A1 | 6/2010 | Shakra et al. |
| 2011/0114388 | A1 | 5/2011 | Lee et al. |
| 2011/0186377 | A1 | 8/2011 | Kline et al. |
| 2013/0032337 | A1 | 2/2013 | Rytlewski et al. |
| 2014/0158356 | A1 | 6/2014 | Andrzejak et al. |
| 2014/0260930 | A1 | 9/2014 | Russell |
| 2015/0021023 | A1 | 1/2015 | Roberts et al. |

FOREIGN PATENT DOCUMENTS

| | | | |
|---|---|---|---|
| CN | 102322216 | A | 1/2012 |
| CN | 102667047 | A | 9/2012 |
| CN | 102822442 | A | 12/2012 |
| CN | 202596572 | U | 12/2012 |
| CN | 103321572 | A | 9/2013 |
| DE | 2420035 | | 3/1976 |
| EP | 0663582 | A3 | 11/1995 |
| EP | 1764577 | A1 | 3/2007 |
| WO | 1999037878 | | 7/1999 |
| WO | 2014149173 | A1 | 9/2014 |
| WO | 2015030730 | | 3/2015 |

OTHER PUBLICATIONS

Portocarrero, Manuel C., "Notice of Allowance dated Feb. 7, 2019", U.S. Appl. No. 15/348,796, The United States Patent and Trademark Office, filed Feb. 7, 2019.

Semick, Joshua T., "Non-final Office Action dated Jul. 18, 2017", U.S. Appl. No. 15/246,414, The United States Patent and Trademark Office, filed Jul. 18, 2017.

Becamel, Philippe, "Patent Cooperation Treaty International Preliminary Report on Patentabililty dated Sep. 15, 2015", Patent Cooperation Treaty Application PCT/US2014/012317, Patent Cooperation Treaty, Sep. 15, 2015.

Committee on Advanced Drilling Technologies, "Drilling and Excavation Technologies for the Future", National Research Council, ISBN: 0-309-57320-3, <<Retrieved from http://www.nap.edu/catalog/2349.html>>, 1994, 176 pages.

Copenheaver, Blaine R., "Patent Cooperation Treaty International Search Report and Written Opinion dated Aug. 10, 2015", Patent Cooperation Treaty Application No. PCT/US2015/030320, Patent Cooperation Treaty, Aug. 10, 2015.

Fang, et al., "Hypersonic Wave Drag Reduction Performance of Cylinders With Repetitive Laser Energy Depositions", 3rd Int'l Photonics & OptoElectronics Meetings (POEM 2010), Journal of Physics: Conference Series 276(2011) 012021, [retrieved on Oct. 20, 2015]. Retrieved from http://iopscience.iop.org/artide/10.1088/1742-596/276/1/012021/pdf>, 8 pages.

Gold, et al., "Concrete Penetration by Eroding Projectiles Experiments and Analysis", Journal of Engineering Mechanics, v122, pp. 145-152 <<Retrieved from ascelibrary.org on Feb. 17, 2013>>, Feb. 1996.

Gold, et al., "Constitutive Models For Concrete Penetration Analysis", Journal of Engineering Mechanics V122 <<Retrieved from ascelibrary.org on Feb. 17, 2013 >>, Mar. 1996, pp. 230-238.

Jingna, Xie, "First Office Action dated Jun. 2, 2016", CN Patent Application No. 2014800162273, The Chinese Intelleclual Property Office, Jun. 2, 2016.

Lundquist, Robert G., "Underground Tests of The Ream Method of Rock Fragmentation for High-Speed Tunneling", Rapid Excavation and Tunneling Conference Proceedings, Ch. 56,<<Retrieved from http://www.onemine.org/view/?d=689528D8459E7257609C73381053FBF203FD5CC5A9FC7839952A414670F0591638551, Mar. 13, 2013>>, Jan. 1974, pp. 825-840.

Semick, Joshua T., "Notice of Allowance dated May 25, 2016", U.S. Appl. No. 14/708,932, The United States Patent and Trademark Office, filed May 25, 2016.

Weber, Jonathan C., "Non-final Office Action dated Dec. 20, 2016", U.S. Appl. No. 15/292,011, The United States Patent and Trade Office, filed Dec. 20, 2016.

Weber, Jonathan C., "Non-Final Office Action dated Jun. 1, 2015", U.S. Appl. No. 13/841,236, The United States Patent and Trademark Office, filed Jun. 1, 2015.

Weber, Jonathan C., "Notice of Allowance dated Jul. 14, 2016", U.S. Appl. No. 13/841,236, The United States Patent and Trademark Office, filed Jul. 14, 2016.

Young, Lee W., "Patent Cooperation Treaty International Search Report and Written Opinion dated Jan. 8, 2016", Patent Cooperation Treaty Application No. PCT/US2015/056947, Patent Cooperation Treaty, Jan. 8, 2016.

(56) References Cited

OTHER PUBLICATIONS

Young, Lee W., "Patent Cooperation Treaty International Search Report and Written Opinion dated Jul. 28, 2016", Patent Cooperation Treaty Application No. PCT/US2016/028704, Patent Cooperation Treaty, Jul. 28, 2016.

Young, Lee W., "Patent Cooperation Treaty International Search Report and Written Opinion dated May 16, 2014", Patent Cooperation Treaty Application No. PCT/US2014/012317, Patent Cooperation Treaty, May 16, 2014

Young, Lee W., "Patent Cooperation Treaty International Search Report and Written Opinion dated Jan. 19, 2017", Patent Cooperation Treaty Application No. PCT/US2016/060129, Patent Cooperation Treaty, Jan. 19, 2017.

Kasten, Klaus, "European Search Report dated Jan. 23, 2017", European Application No. 14770528.9, European Patent Office, Jan. 23, 2017.

Sayre, James G., "Non-Final Office Action dated Aug. 24, 2017", U.S. Appl. No. 14/919,657, The United States Patent and Trademark Office, filed Aug. 24, 2017.

Thomas, Shane, "Patent Cooperation Treaty International Search Report and Written Opinion dated Feb. 2, 2017", Patent Cooperation Treaty Application No. PCT/US16/61660, Patent Cooperation Treaty, Feb. 2, 2017.

Bogdanoff, David W., "New Tube End Closure System For The Ram Accelerator," Journal of Propulsion and Power., vol. 10, No. 4, Jul. 1-Aug. 1994, pp. 518-521.

Hansen, Viggo, "Ram Accelerator Animation", YouTube, Science & Technology, Uploaded on May 2, 2011. Retrieved from the Internet: https://www.youtube.com/watch?v=iFQfOKVi98l.

Van Berlo, Andre, "European Search Report dated Sep. 7, 2017", European Patent Application No. 15791990.3, European Patent Office, Sep. 7, 2017.

Wittmann-Regis, Agnes, "PCT International Preliminary Report on Patentability dated May 24, 2018", Patent Cooperation Treaty Application No. PCT/US16/60129, Patent Cooperation Treaty, May 24, 2018.

Beaufumé, Cédric, "Extended European Search Report dated Oct. 25, 2018", The European Patent Office, EP Application No. 20160783882, PCT/US2016028704, Oct. 25, 2018.

Gold, et al., "Concrete Penetration By Eroding Projectiles Experiments and Analysis", Journal of Engineering Mechanics, v122, Feb. 1996, pp. 145-152 [Retrieved from: ascelibrary.org on Feb. 17, 2013.].

Hansen, Viggo, "Ram Accelerator Animation", Published on May 2, 2011.

Semick, Joshua T., "Notice of Allowance dated Dec. 3, 2018", U.S. Appl. No. 15/246,414 The United States Patent and Trademark Office, Dec. 3, 2018.

Young, Lee W., "International Search Report and Written Opinion dated Nov. 29, 2017", Patent Cooperation Treaty Application No. PCT/US17/50736, Patent Cooperation Treaty, Nov. 9, 2017.

PROJECTILE DRILLING SYSTEM

CROSS-REFERENCE TO RELATED APPLICATIONS

This patent application claims priority to the pending United States provisional application for patent, having application Ser. No. 62/253,228, filed on Nov. 10, 2015, entitled "Pressurized Ram Accelerator System". Application 62/253,228 is incorporated by reference herein in its entirety.

This patent application also claims priority to the pending United States provisional application for patent, having application Ser. No. 62/255,161, filed on Nov. 13, 2015, entitled "Down-Hole Hyperdrill". Application 62/255,161 is incorporated by reference herein in its entirety.

INCORPORATION BY REFERENCE

In addition to Application 62/253,228 and Application 62/255,161, which are incorporated by reference in their entirety above, the following are incorporated by reference for all that they contain:

U.S. patent application Ser. No. 13/841,236, filed on Mar. 15, 2013, entitled "Ram Accelerator System".

U.S. patent application Ser. No. 15/292,011, filed on Oct. 12, 2016, entitled "Ram Accelerator System".

U.S. provisional patent application No. 61/992,830, filed on May 13, 2014, entitled "Ram Accelerator System with Endcap".

U.S. patent application Ser. No. 14/708,932, now U.S. Pat. No. 9,458,670, filed on May 11, 2015, entitled "Ram Accelerator System with Endcap".

U.S. patent application Ser. No. 15/246,414, filed on Aug. 24, 2016, entitled "Ram Accelerator System with Endcap".

U.S. provisional patent application No. 62/067,923, filed on Oct. 23, 2014, entitled "Ram Accelerator System with Rail Tube".

U.S. patent application Ser. No. 14/919,657, filed on Oct. 21, 2015, entitled "Ram Accelerator System with Rail Tube".

U.S. provisional patent application No. 62/150,836, filed on Apr. 21, 2015, entitled "Ram Accelerator System with Baffles".

U.S. patent application Ser. No. 15/135,452, filed on Apr. 21, 2016, entitled "Ram Accelerator System with Baffles".

U.S. provisional patent application No. 62/393,631, filed on Sep. 12, 2016, entitled "Augmented Drilling System Using Ram Accelerator Assembly".

BACKGROUND

Traditional drilling and excavation methods utilize drills to form holes in one or more layers of material to be penetrated. Excavation, quarrying, and tunnel boring may also use explosives placed in the holes and detonated to break apart at least a portion of the material. The use of explosives results in additional safety and regulatory burdens which increase operational cost. Typically drilling, blasting, removal of material, and ground support are relatively slow processes. A time ranging from many minutes to many hours to days may typically be required to remove material and extend the depth of a hole by a linear foot, depending on the cross-sectional area of material being moved.

BRIEF DESCRIPTION OF DRAWINGS

Certain implementations and embodiments will now be described more fully below with reference to the accompanying figures, in which various aspects are shown. However, various aspects may be implemented in many different forms and should not be construed as limited to the implementations set forth herein. The figures are not necessarily to scale, and the relative proportions of the indicated objects may have been modified for ease of illustration and not by way of limitation. Like numbers refer to like elements throughout.

DETAILED DESCRIPTION

Figure 1:
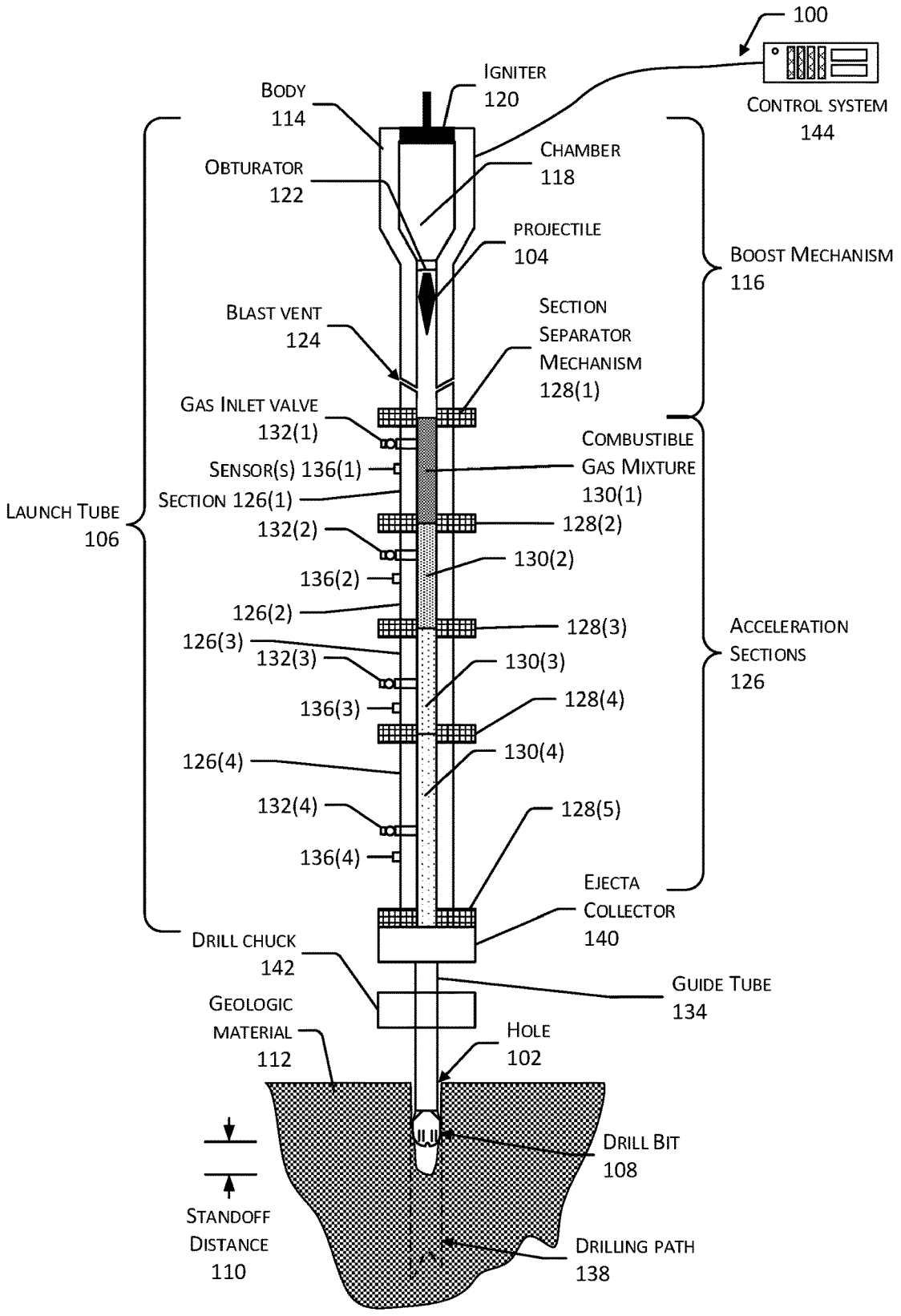
FIG. 1 is an illustrative system for drilling or excavating using a ram accelerator comprising a plurality of sections holding one or more combustible gasses configured to propel a projectile towards a working face of material.

Conventional drilling and excavation techniques used for penetrating materials typically rely on mechanical bits used to cut or grind at a working face. Penetrated materials may include metals, ceramics, geologic materials, and so forth. Tool wear and breakage associated with mechanical bits may slow these operations, increasing costs. Furthermore, the low rate of progress when cutting through a resistant material, such as hard rock, may be prohibitive due to the time or cost required. Drilling through a geological formation may be used in the establishment of water wells, oil wells, gas wells, underground pipelines, and so forth. The environmental impact of conventional drilling techniques may be significant. For example, conventional drilling techniques may require a significant supply of water, which may not be readily available in arid regions. As a result, resource extraction may be prohibitively expensive, time consuming, or both.

Described in this disclosure are systems and techniques for ejecting one or more projectiles toward the working face of the geologic material. In one implementation, the projectile(s) may be ejected using a ram accelerator. For example, a ram accelerator may include a launch tube through which the projectile is accelerated. In some cases, the launch tube may be separated into multiple sections, one or more of which may be configured to hold one or more combustible gasses or other propellant materials. Pressure from the propellant materials may accelerate the projectile through the launch tube, out an orifice thereof, and into contact with a geologic material. In some implementations, the projectile may be accelerated to a ram velocity down the launch tube, at which a ram compression effect provided at least in part by a shape of the projectile may initiate combustion of the one or more combustible gasses in a ram combustion effect, accelerating the projectile. In some implementations, the projectile may be accelerated to a hypervelocity. In some implementations, a hypervelocity includes velocities greater than or equal to two kilometers per second upon ejection or exit from the launch tube. In other implementations, the projectile may accelerate to a non-hypervelocity. In some implementations, non-hypervelocity includes velocities less than two kilometers per second.

The projectiles ejected from the launch tube may strike a working face of the geologic material. Projectiles travelling at hypervelocity typically interact with the geologic material at the working face as a fluid-fluid interaction upon impact, due to the substantial kinetic energy in the projectile. This interaction may form a hole which is generally in the form of a cylinder. In some implementations, the length of the hole may be increased by firing a series of projectiles. In comparison, projectiles travelling at non-hypervelocity may interact with the geologic material at the working face as a solid-solid interaction. This interaction may fracture or fragment the geologic material, and may form a hole which is cylindrical or a crater having a conical profile.

In some implementations, a section separator mechanism may be configured to provide one or more barriers between different sections of a launch tube. One or more of the sections may contain one or more combustible gasses. In some cases, different sections may be configured to contain different combustible gasses, different quantities of gasses, gasses at different particular pressures, and so forth. The section separator mechanism(s) may include one or more of a diaphragm, valve, plate, endcap, gravity gradient, or other type of closure mechanism or separation technique that may seal one or more sections. During acceleration of a projectile, the projectile may pass through the seal, such as by penetrating through a diaphragm, or the seal may be broken, such as by opening a valve. If a diaphragm is used, a reel mechanism may be used to move an unused section of the diaphragm into place, restoring the seal. Other separator mechanisms such as ball valves, plates, endcaps, gravity gradient, and so forth may be moved from a position that permits passage of the projectile to a position that seals one or more sections of the launch tube. In some cases, a section separator mechanism may be replaced. In some implementations, one or more of the separator mechanisms may be configured to operate as blow out preventers, anti-kick devices, and so forth. For example, the separator mechanisms may comprise ball valves configured to close when pressure from down the hole exceeds a threshold pressure.

In some implementations, the hole formed by the impact of the projectile(s) may be further guided or processed. For example, a guide tube (also known as a "drift tube") may be inserted into the hole to prevent subsidence, direct a drilling path, deploy instrumentation, and so forth. In one implementation, a reamer or slip-spacer may be coupled to the guide tube and inserted downhole. The reamer may comprise one or more cutting or grinding surfaces configured to shape the hole into a substantially uniform cross section. For example, the reamer may be configured to smooth the sides of the hole. In some implementations, the reamer may also be configured to apply lateral force between the guide tube and the walls of the hole, canting or otherwise directing the reamer and guide tube in a particular direction. This directionality may enable accelerated projectiles to form a hole having a curved shape.

The guide tube may be configured to accept the projectiles ejected from the launch tube and direct the projectiles toward the working face. In some cases, a series of projectiles may be accelerated to the guide tube, allowing for continuous drilling operations. Other operations may also be provided, such as inserting a continuous concrete liner into the hole.

Ejecta, such as debris and other materials resulting from the impact of the one or more projectiles with the geologic material may be removed from the hole. In some implementations, a back pressure resulting from the impact of the projectile may force the ejecta from the hole. In other implementations, a working fluid such as compressed air, water, and so forth may be injected into the hole to aid in removal of at least a portion of the ejecta. In some implementations, a fluid may be injected continuously, prior to, during, or after, each launch of a projectile.

In some implementations, one or more ram accelerators may be deployed to drill several holes for tunnel boring, excavation, and so forth. For example, a plurality of ram accelerators may be fired sequentially or simultaneously to strike one or more target points on a working face. After several holes are formed from projectile impacts, various techniques may be used to remove pieces of geologic material defined by two or more holes which are proximate to one another. For example, mechanical force may be applied by breaker arms to snap, break, or otherwise free pieces of the geologic material from a main body of the geologic material at the working face. In other implementations, explosives or other combustible or pressurized materials may be placed into the drilled holes and detonated to displace the geologic material.

In some implementations, other drilling techniques and equipment may be used in conjunction with accelerated projectiles to form a hole. For example, accelerated projectiles may be used to reach a particular target depth, after which a coring drill may be used to retrieve core samples from strata at the target depth. As another example, a drill bit or other cutting tool may be affixed to a lower end of the launch tube or guide tube. For example, a tri-cone drill bit may be affixed to an end of the guide tube. The drill bit or cutting tool may have an aperture through which the projectile may pass and impact the working face. The cutting tool may be operated during impact, or it may be idle during impact.

The systems and techniques described may be used to reduce the time, costs, and environmental impact associated with resource extraction, resource exploration, construction, and so forth. Furthermore, drilling using accelerated projectiles may enable deeper exploration and recovery of natural resources. Additionally, the energy released during impact of projectiles may be used for geotechnical investigation such as reflection seismology, strata characterization, and so forth.

Illustrative Systems and Mechanisms

FIG. 1 is an illustrative system 100 for drilling or excavating a hole 102 using a projectile 104 accelerated through a launch tube 106 in combination with a drill bit 108. The lower end of the launch tube may be positioned at a standoff distance 110 from geologic material 112 or another target material. The geologic material 112 may include rock, dirt, ice, and so forth. The launch tube 106 has a body 114, which in some implementations may include one or more materials such as steel, carbon fiber, ceramics, and so forth.

The upper end of the launch tube 106 may include a boost mechanism 116, which may be used to accelerate or propel the projectile 104 through the launch tube 106 toward the geologic material 112. The boost mechanism 116 may include one or more of a gas gun, electromagnetic launcher, solid explosive charge, liquid explosive charge, backpressure system, and so forth. In some implementations, the boost mechanism 116 may include one or more propellant materials, such as a combustible or pressurized gas, that is placed in a chamber 118 thereof, which may be ignited, using an igniter 120, to accelerate the projectile 104. In other implementations, the boost mechanism 116 may operate by providing a relative differential in speed between the projectile 104 and particles in one or more combustible gasses which is equal to or greater than a ram velocity. The ram velocity is the velocity of the projectile 104, relative to particles in the one or more combustible gasses, at which the ram effect occurs. In some implementations, at least a portion of the launch tube 106 within the boost mechanism 116 may be maintained at a vacuum prior to launch.

FIG. 1 depicts the boost mechanism 116 including a detonation gas gun in which the igniter 120 is coupled to the chamber 118 to generate an energetic reaction by igniting combustible, explosive, or detonable materials within the chamber 118. The chamber 118 may be coupled to the lower portions of the launch tube 106 within which the projectile 104 is placed. In some implementations, the projectile 104 may include or be adjacent to an obturator 122 configured to seal at least temporarily the chamber 118 from the lower portions of the launch tube 106. For example, the obturator 122 may be attached to the projectile 104, integrated but frangible from the projectile 104, or a separate structure from the projectile 104. In some implementations, one or more blast vents 124 in the launch tube 106 may release byproducts or excess pressure from combustion or detonation reactions. The launch tube 106 may be smooth, rifled, include one or more guide rails or other guide features, and so forth. The launch tube 106, or portions thereof, may be maintained at a pressure which is lower than that of the ambient atmosphere. For example, portions of the launch tube 106 such as those in the boost mechanism 116 may be evacuated to a pressure of less than 25 torr.

In some implementations, in addition to accelerating the projectile 104 through the launch tube 106, the boost mechanism 116 may be configured to initiate a ram effect with the projectile 104. A ram effect may result in compression of one or more combustible gasses proximate to the projectile 106 and subsequent combustion of the combustible gasses proximate to a back side of the projectile 106. For example, compression may result in heating of the one or more combustible gasses, triggering ignition. The ignited gasses combusting in an exothermic reaction may impart an impulse on the projectile 104 to further accelerate the projectile 104 through the launch tube 106. In some implementations ignition of the combustible gasses may be assisted or initiated using one or more igniters 120. For example, an igniter 120 may be affixed to or a portion of the projectile 104 or at a location within the launch tube 106.

In some implementations, the boost mechanism 116 may use one or more of an electromagnetic force, solid explosive charge, liquid explosive charge, stored compressed gasses, and so forth to propel the projectile 104 along the launch tube 106. In some cases, propelling the projectile 104 may cause the projectile 104 to reach the ram velocity. In other implementations, a backpressure system may be used to accelerate one or more combustible gasses past a stationary projectile 104, causing the initially stationary projectile 104 to produce a ram effect. For example, a combustible gas under high pressure may be exhausted from ports within the launch tube 106 past the projectile 104 while the projectile 104 is stationary at the upper end or another location within the launch tube 106. In some implementations, the pressure of the combustible gas may range from less than atmospheric up to 10,000 psi absolute. The relative velocity difference between the gas(ses) and the projectile 104 may achieve the ram velocity, causing combustion of the gas(ses) and beginning to accelerate the projectile 104 through the launch tube 106. Hybrid systems may also be used, in which the projectile 104 is moved and backpressure is applied simultaneously.

In some implementations, the projectile 104 may travel from the end of the launch tube 106 near the boost mechanism 116 into one or more acceleration sections 126. The acceleration sections 126 (or "sections") may be bounded by section separator mechanisms 128. The section separator mechanisms 128 may provide at least a partial seal between acceleration sections 126, such as to maintain a combustible gas mixture 130 admitted into one or more of the sections 126 via one or more gas inlet valves 132, within the particular section 126. In some implementations, different sections 126 may contain different combustible gas mixtures 130.

The section separator mechanisms 128 may include ball valves or other types of values, diaphragms, gravity gradients, liquids, endcaps, or other structures or materials configured to maintain at least a partial seal between respective sections 126. In one implementation described below with regard to FIG. 3, a diaphragm may be deployed using a reel mechanism, allowing for relatively rapid reset of the diaphragms following their penetration by the projectile 104 during passage of the projectile 104 through the launch tube 106. In other implementations, the launch tube 106 may be arranged at an angle which is not perpendicular to vertical, such that gravity holds the different combustible gas mixtures 130 at different heights, based on their relative densities. For example, lighter combustible gas mixtures 130 may "float" on top of heavier combustible gas mixtures 130 which sink or remain near the bottom of the launch tube 106. In another example, fluid at the bottom of the hole 102 may provide a seal which allows a guide tube 134 below the launch tube 106 to be used as a section of the launch tube 106. For example, the guide tube 134 may be used as an acceleration section 126. In some implementations, the guide tube 134 may contain a combustible gas mixture 130.

In the implementation shown in FIG. 1, four acceleration sections 126(1)-(4) are depicted, maintained by five section separator mechanisms 128(1)-(5), each of the sections filled with respective combustible gas mixtures 130(1)-(4). In other implementations, different numbers of sections 126, section separator mechanisms 128, and so forth may be used. The combustible gas mixture(s) 130 may include one or more combustible gasses. The one or more combustible gasses may include an oxidizer or an oxidizing agent. For example, one or more combustible gas mixtures 130 may include hydrogen and oxygen gas in a ratio of 2:1. Other combustible gas mixtures 130 may be used, such as silane and carbon dioxide. The combustible gas mixture(s) 130 may be provided by extraction from ambient atmosphere, electrolysis of a material such as water, from a solid or liquid gas generator using solid materials which react chemically to release a combustible gas, from a previously stored gas or liquid, and so forth.

One or more acceleration sections 126 may contain the same combustible gas mixtures 130 or different combustible gas mixtures 130. Differences between combustible gas mixtures 130 may include chemical composition, pressure, temperature, and so forth. For example, the density of the combustible gas mixtures 130 in each of the sections 126 (1)-(4) may decrease along the length of the launch tube 106, such that the section 126(1) holds a combustible gas mixture 130 at a higher pressure than the section 126(4). In another example, the combustible gas mixture 130(1) in the section 126(1) may include oxygen and propane while the combustible gas mixture 128(3) may include oxygen and hydrogen.

One or more sensors 136 may be configured at one or more positions along the launch tube 106. These sensors may include pressure sensors, chemical sensors, density sensors, fatigue sensors, strain gauges, accelerometers, proximity sensors, and so forth.

The accelerated projectile 104 may exit the lower end of the launch tube 106 and progress toward a working face of the geologic material 112 or other material to be penetrated. Upon impact of the projectile 104 with the geologic material 112, the hole 102 may be formed, or the length of an existing hole 102 may be increased.

In some cases, a series of projectiles 104 may be accelerated to form a hole 102 which grows in length with each impact. In some implementations, the projectiles 104 accelerated through the launch tube 106 may reach a hypervelocity. Hypervelocity may include velocities greater than or equal to two kilometers per second upon ejection or exit of the projectile 104 from the launch tube 106.

In other implementations, the projectile 104 may accelerate to a non-hypervelocity. Non-hypervelocity includes velocities below two kilometers per second. The terms hypervelocity and non-hypervelocity may also be characterized based on interaction of the projectile 104 with the geologic material 112 or other target material. For example, hypervelocity impacts may be characterized by a fluid-fluid type interaction, while non-hypervelocity impacts are not. These interactions are discussed below in more detail with regard to FIGS. 6 and 7.

In some implementations, a guide tube 134 may be inserted into the hole 102 at or proximate to the lower end of the launch tube 106 to extend the launch tube 106 into the hole 102. The interior of the guide tube 134 may be smooth, rifled, include one or more guide rails or other guide features, and so forth. The guide tube 134 may provide a pathway for projectiles 104 to travel from the lower end of the launch tube 106 to the portion of the geologic material 112 being drilled. The guide tube 134 may also be used to prevent subsidence, direct a drilling path, deploy instrumentation, deploy a reamer, and so forth. One or more guide tubes 134 may thus follow along a drilling path 138 which may be formed by impacts of one or more projectiles 104. The guide tube 134 may comprise a plurality of sections coupled together, such as with threads, clamps, and so forth. The guide tube 134 may be circular, oval, rectangular, triangular, or describe a polyhedron in cross section. The guide tube 134 may comprise one or more tubes or other structures which are nested one within another. For example, the guide tube 134 may include an inner tube and an outer tube which are mounted coaxially, or with the inner tube against one side of the outer tube.

Formation of the hole 102 using the impact of the projectiles 104 may result in increased drilling speed compared to conventional drilling using drill bits 108, such as by minimizing work stoppages associated with adding more guide tube 134. For example, the standoff distance 110 may increase or decrease to a distance ranging from zero to hundreds of feet. In some implementations, after extending the hole 102 using projectiles 104, acceleration of projectiles 104 may be ceased while one or more additional guide tube 134 sections are inserted. In comparison, conventional drilling may involve ceasing drilling operations every ten feet to add a new section of drill pipe, which may result in slower progress.

The direction of the drilling path 138 may be changed by modifying one or more firing parameters of the projectiles 104, moving the guide tube 134, and so forth. For example, reamers or other elements on the guide tube 134 may exert a lateral force, such as by pushing against the walls of the hole 102, which may orient the guide tube 134 to a particular direction, such that a successive projectile 104 may be ejected at an angle non-parallel to the longitudinal axis of the launch tube 106, guide tube 134, or hole 102, enabling a curved drilling path 138 to be formed.

An ejecta collector 140 may collect or capture at least a portion of ejecta that results from the impacts of the projectiles 104 with the geologic material 112. In some implementations, the ejecta collector 140 may be placed proximate to a top of the hole 102, such as coupled to the guide tube 134 or launch tube 106.

In some implementations, a drill chuck 142 may be mechanically coupled to the guide tube 134, such that the guide tube 134 may be raised, lowered, rotated, tilted, and so forth. Because the geologic material 112 may be removed by the impact of the projectiles 104 therewith, the end of the guide tube 134 may not necessarily support the loads associated with traditional mechanical drilling techniques. As a result, the drill chuck 142 may apply less torque to the guide tube 134 compared to conventional drilling.

The depicted system 100 may be used in conjunction with conventional drilling techniques. One example of such techniques is discussed in more detail below with regard to FIG. 2.

In some implementations, a control system 144 may be coupled to the launch tube 106, the one or more sensors 136, one or more sensors in the projectiles 104, and so forth. The control system 144 may comprise one or more processors, memory, interfaces, and so forth which are configured to facilitate acceleration of the projectiles 104. The control system 144 may couple to the one or more section separator mechanisms 128, the gas inlet valves 132, and the sensors 136 to coordinate the configuration of the launch tube 106 for ejection of projectiles 104. For example, the control system 144 may control the filling of particular sections 126 with particular combustible gas mixtures 130, recommend a particular projectile 104 type form a particular hole 102 in a particular geologic material 112, and so forth.

In some implementations, instead of or in addition to the section separator mechanism(s) 128, baffles or annular members may be placed within the acceleration sections 126. The baffles may be configured to allow passage of projectiles 104 during operation.

Other mechanisms may be present which are not depicted here. For example, an injection system may be configured to add one or more materials in the wake of projectiles 104. For example, injected materials may be used to clean the launch tube 106 or guide tube 134, remove debris, and so forth. Continuing the example, powdered silica may be injected in the wake of a projectile 104, such that at least a portion of the silica is pulled along by the wake down the launch tube 106, into the hole 102, or both.

In some implementations, a drift tube may be positioned between the launch tube 106 and the guide tube 134 or the hole 102. The drift tube may provide a continuous pathway for the projectile 104.

Figure 2:
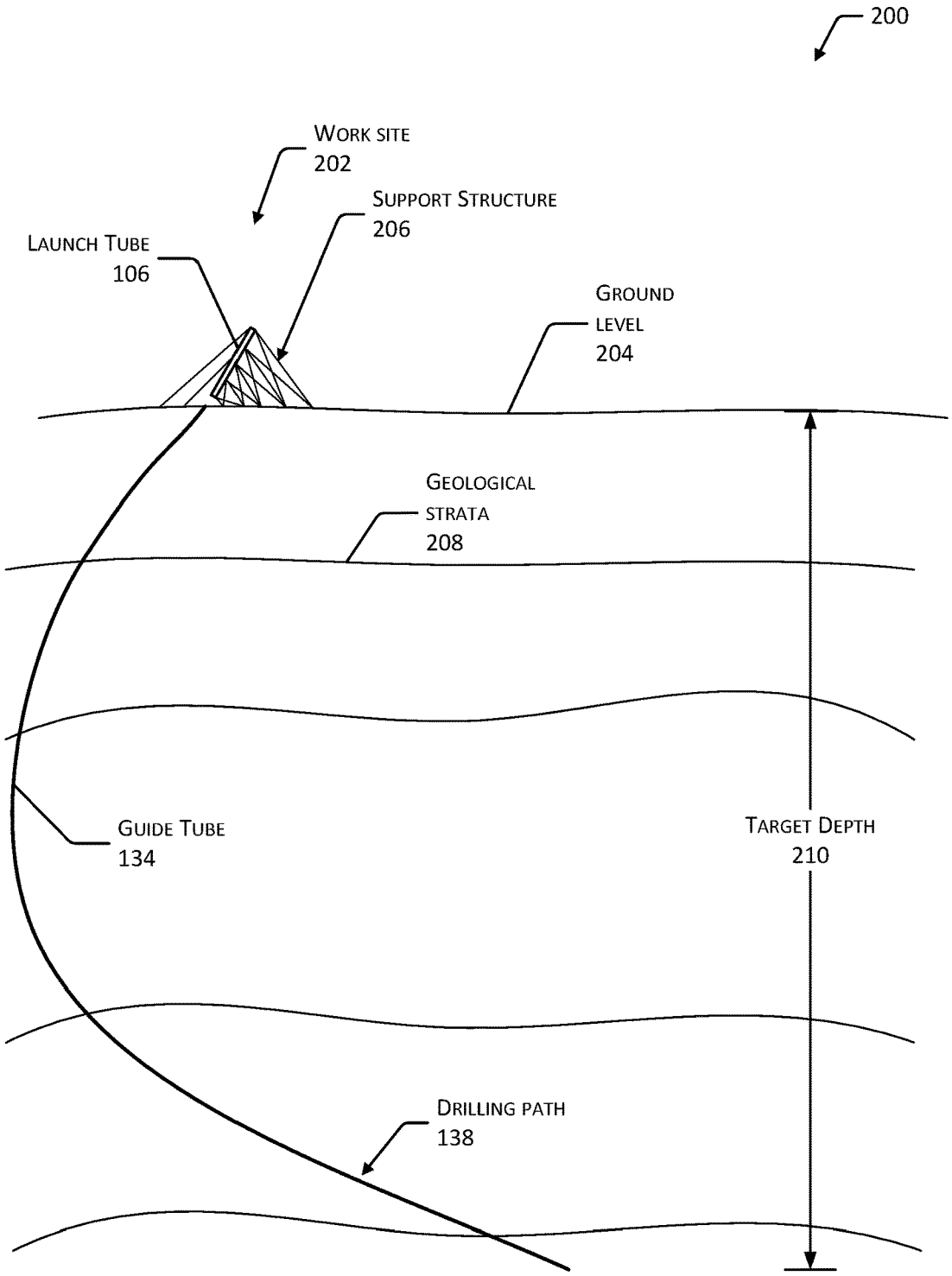
FIG. 2 illustrates a curved drilling path formed using ram accelerator drilling.

FIG. 2 illustrates a scenario 200 in which a curved drilling path 138 may be formed at least in part using accelerated projectiles 104. A work site is shown 202 at ground level 204. At the work site 202, a support structure 206 may support at least a portion of the launch tube 106. For example, the support structure 206 may comprise a derrick, crane, scaffold, and so forth. In some implementations, the overall length of the launch tube 106 may range from 75 to 300 feet. The support structure 206 may maintain the launch tube 106 in a substantially straight line, in a desired orientation during acceleration of projectiles 104. By minimizing deflection of the launch tube 106 during acceleration of projectiles 104, side loads exerted on the body 114 are reduced. In some implementations, a plurality of launch tubes 106 may be moved in and out of position in front of the hole 102 to fire a projectile 104, such that one launch tube 106 may be used to accelerate a projectile 104 while another launch tube 106 is being loaded.

The launch tube 106 may be arranged vertically, at an angle, or horizontally, depending upon the particular task. For example, while drilling a well in a vertical direction, the launch tube 106 may be positioned substantially vertically. In comparison, while boring a tunnel or drilling a well in a horizontal direction, the launch tube 106 may be positioned substantially horizontally. Additionally, while FIG. 2 depicts the launch tube 106 located at or near the ground level 204 of the work site 202, in some implementations the launch tube 106 or a portion thereof may extend or be placed within the hole 102. For example, the launch tube 106 may be lowered within the hole 102, such as through the guide tube 134, and acceleration of projectiles 104 may be performed at a depth below ground level 204. In another implementation, the guide tube 134, or a portion thereof, may be used as an additional launch tube 106 to accelerate projectiles 104 from a lower depth. For example, a lower portion of the guide tube 134 in the hole 102 may be provided with a combustible gas mixture 130 to provide acceleration to a projectile 104.

Due to the ability to orient the launch tube 106 in non-vertical orientations and to position the launch tube 106 downhole, the drilling path 138 may be extended in a direction that bends or curves along one or more radii of curvature. In one implementation, the direction and the radius of curvature may be determined based at least in part on the side loads imposed on the guide tube 134 or launch tube 106 during acceleration of the projectile 104 within.

The ability to direct the drilling path 138 may enable particular points in space below ground level 204 to be reached, or to avoid particular regions. For example, the drilling path 138 may be configured to avoid a subsurface reservoir. As shown in FIG. 2, the drilling path 138 may pass through several layers of geological strata 208, to a final target depth 210. In some implementations, at the target depth 210, or at other points in the drilling path 138 during impacting, the ejecta from the impacts of the projectiles 104 may be analyzed to determine composition of the various geological strata 208.

In some implementations, accelerated projectiles 104 may be used in conjunction with other drilling techniques or equipment. For example, accelerated projectiles 104, and in some embodiments, a drill bit 108 as shown in FIG. 1, may be used to rapidly reach a previously designated target depth 210. After reaching the target depth 210, other drilling techniques or equipment may use the hole 102 for operations such as cutting core samples. Once the core sample or other operation has been completed, use of accelerated projectiles 104 may resume and additional projectiles 104 may be used to increase the length of the drilling path 138.

In another implementation, the projectile 104 may be shaped to capture or measure one or more material characteristics of the geologic material 112 or analyze material interaction between the projectile 104 and the geologic material 112 or other target material. For example, samples of projectile 104 fragments may be recovered from the hole 102, such as through core drilling and recovery of the projectile 104. In some implementations, sensors associated with the projectile 104 may transmit information to the control system 144.

Figure 3:
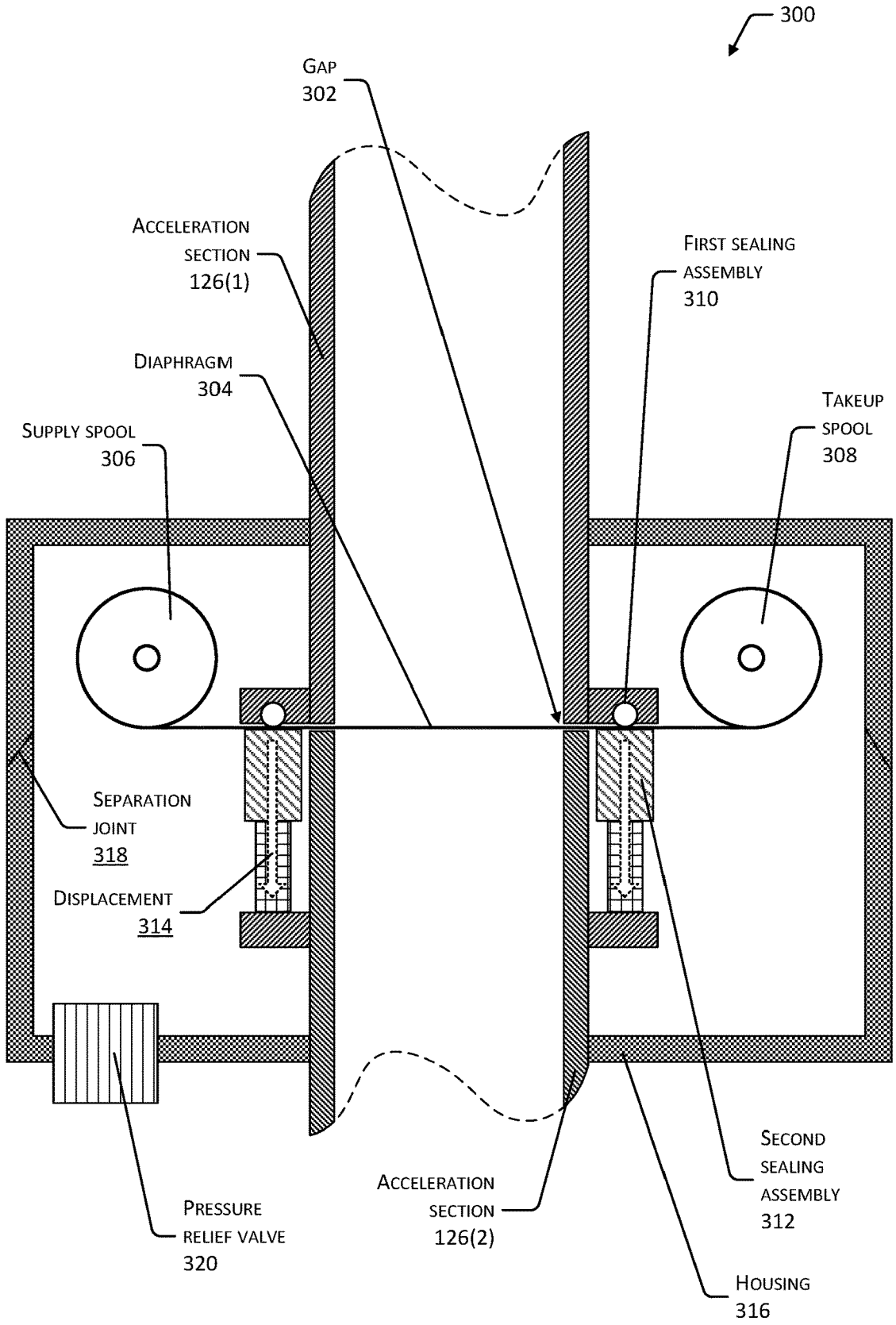
FIG. 3 illustrates a section separator mechanism configured to reset a diaphragm penetrated during launch of the projectile such that a seal is maintained between the sections of the ram accelerator.

FIG. 3 illustrates a mechanism 300 of one implementation of a section separator mechanism 128. As described above, several techniques and mechanisms may be used to maintain a separation between acceleration sections 126. The mechanism 300 shown in FIG. 3 may be arranged at one or more ends of a particular acceleration section 126. For example, the mechanism 300 may be between the sections 126(1) and 126(2) as shown FIG. 3, at the lower end of the section 126(4), and so forth.

A gap 302 may be defined between the walls of the body 114 of the launch tube 106. Through the gap 302, or in front of the lower end of the launch tube 106, a diaphragm 304 may be positioned. The diaphragm 304 may function to maintain combustible gas mixtures 130 within respective sections 126 of the launch tub 106, prevent ambient atmosphere from entering an evacuated section 126, and so forth.

The diaphragm 304 may comprise one or more materials including, but not limited to, metal, plastic, ceramic, and so forth. For example, the diaphragm 304 may comprise aluminum, steel, copper, Mylar, and so forth. In some implementations, a carrier or supporting matrix or structure may be arranged around at least a portion of the diaphragm 304. At least a portion of the diaphragm 304 may be penetrated by the projectile 104 during acceleration of the projectile 104 through the launch tube 106. In some implementations, the portion of the diaphragm 304 which is configured to be penetrated may differ in one or more ways from the carrier. For example, the carrier may be thicker, have a different composition, and so forth. In some implementations, the portion of the diaphragm 304 which is configured to be penetrated may be scored or otherwise designed to facilitate penetration by the projectile 104.

A supply spool 306 may store a plurality of diaphragms 304 in a carrier strip, or a diaphragm material, with penetrated diaphragms being taken up by a takeup spool 308.

A seal may be maintained between a section 126 and the diaphragm 304 by compressing a portion of the diaphragm 304, or the carrier holding the diaphragm 304, between a first sealing assembly 310 and a corresponding second sealing assembly 312, which may be positioned on opposite sides of the launch tube 106. The second sealing assembly 312 is depicted as being configured to be displaced as indicated along the arrow 314 toward or away from the first sealing assembly 310, to allow for making or breaking the seal and movement of the diaphragm 304.

During evacuation or filling of a section 126, a diaphragm 304, as sealed between the first sealing assembly 310 and the second sealing assembly 312, may seal the section 126. As a projectile 104 is accelerated through the launch tube, the projectile 104 may penetrate the diaphragm 304, creating a hole. Material may be spooled from the supply spool 306 to the takeup spool 308, such that an intact portion of a diaphragm 304 is brought into the launch tube 106 and subsequently sealed by the sealing assemblies.

A housing 316 may be configured to enclose the spools, sealing assemblies, and so forth. Various access ports or hatches may be provided which allow for maintenance such as removing or placing the supply spool 306, the takeup spool 308, and so forth. A separation joint 318 may be provided which allows for separation of the acceleration sections 126 from one another. The housing 316, the separation joint 318, and other structures may be configured to maintain alignment of the launch tube 106 during operation. The housing 316 may be configured with one or more pressure relief valves 320. These pressure relief valves 320 may be used to release pressure resulting from acceleration of projectiles 104, changes in atmospheric pressure, and so forth.

While FIG. 3 depicts the first acceleration section 126(1) and second acceleration section 126(2) as one example of placement of a section separator mechanism 128, it is understood that the mechanism 300 may be employed between other sections 126, at the end of other sections 126, and so forth.

In other implementations, instead of a spool, the diaphragm 304 may be arranged as plates or sheets of material. A feed mechanism may be configured to change these plates or sheets to replace penetrated diaphragms 304 with intact diaphragms 304.

In other implementations, a section separator mechanism 128 may include a plate configured to be slid into and out from the gap 302 within the launch tube 106, such as a gate valve. Other valves such as ball valves may also be used. One or more of these various mechanisms may be used in the same launch tube 106 during the same firing operation. For example, the mechanism 300 shown in FIG. 3 may be used at the lower end of the launch tube 106, while ball or gate valves may be used between other sections 126.

The section separator mechanisms 128 may be configured to fit within the guide tube 134, or to be placed down within the hole 102. This arrangement may enable the acceleration sections 126 to extend into the hole 102, such as for use at a downhole depth. For example, the mechanism 300 may be deployed into the hole 102 such that multiple projectiles 104 may be accelerated within the hole 102.

Figure 4:
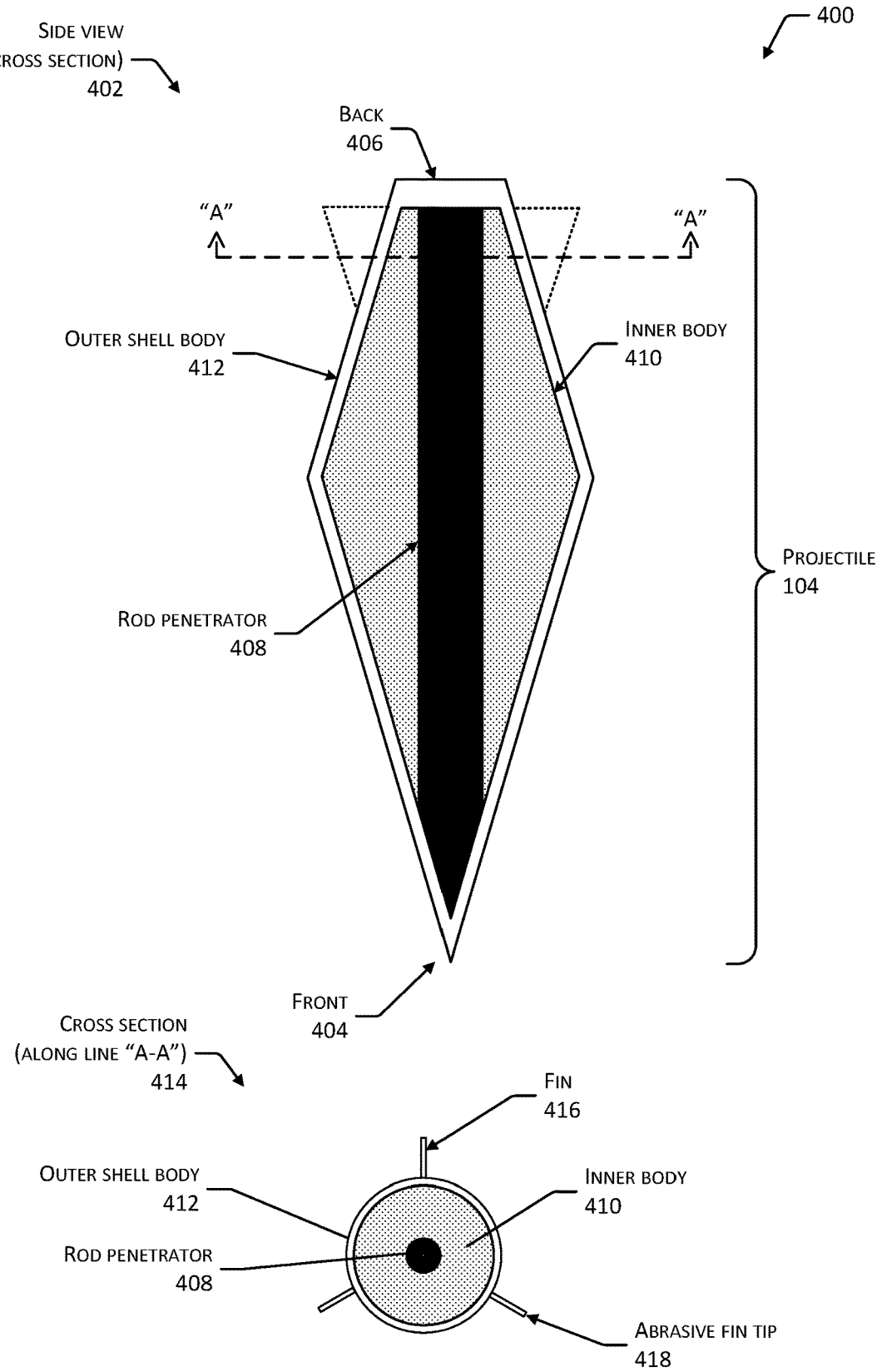
FIG. 4 illustrates a projectile configured to be accelerated using a ram combustion effect.

FIG. 4 illustrates two views 400 of one implementation of a projectile 104. A side-view 402 depicts the projectile 104 as having a front 404, a back 406, a rod penetrator 408, an inner body 410, and an outer shell body 412. The front 404 may be positioned closer to the lower end of the launch tube 106 than the back 406 such that the front 404 exits the launch tube 106 before the back 406 during acceleration of the projectile 104.

The rod penetrator 408 may comprise one or more materials such as metals, ceramics, plastics, and so forth. For example, the rod penetrator 408 may comprise copper, depleted uranium, and so forth. In some cases, an explosive material, such as a plastic explosive or specialized explosive may be embedded in the rod penetrator 408.

The inner body 410 of the projectile 104 may comprise a solid plastic material or other material to entrain into the hole 102, such as an explosive material, a hole cleaner, a seepage stop material, water, ice, and so forth. In another embodiment, the outer shell body 412 may be connected to a lanyard train configured to pull a separate explosive material into the hole 102. As the projectile 104 penetrates the geologic material 112, the explosive material, whether embedded into a portion of the projectile 104 or separately carried, may be entrained into the hole 102, where it may be detonated.

In some implementations, at least a portion of the projectile 104 may include a material which is combustible. For example, the outer shell body 412 may include aluminum. In some implementations, the projectile 104 may omit onboard propellant.

The back 406 of the projectile 104 may include an obturator 122 which may prevent the passage of a combustible gas mixture 130 or other materials past the projectile 104 as the projectile 104 accelerates through the launch tube 106. The obturator 122 may be an integral part of the projectile 104 or a separate and detachable unit.

Cross section 414 illustrates a view along the plane indicated by line A-A in the side view 402. The projectile 104 may include one or more fins 416, rails, or other guidance features. For example, the projectile 104 may be rifled to induce spiraling. The fins 416 may be positioned toward the front 404 of the projectile 104, the back 406 of the projectile 104, or both the front 404 and back 406, to provide guidance during acceleration and ejection of the projectile 104. In some implementations, the fins 416 may be coated with an abrasive material that aids in cleaning the launch tube 106 as the projectile 104 is accelerated therethrough to penetrate the geologic material 112. In other implementations one or more of the fins 416 may include an abrasive fin tip 418. In some implementations, the body of the projectile 104 may extend outward to form a fin 416 or other guidance feature. The abrasive fin tip 418 may be used to clean the launch tube 106 or guide tube 134 during passage of the projectile 104.

In some implementations, the projectile 104 may incorporate one or more sensors or other instrumentation. The sensors may include accelerometers, temperature sensors, gyroscopes, and so forth. Information from these sensors may be provided to receiving equipment using radio frequencies, optical transmission, acoustic transmission, and so forth. This information may be used to modify the one or more parameters for accelerating the projectile 104, characterize material in the hole 102, and so forth.

Figure 5:
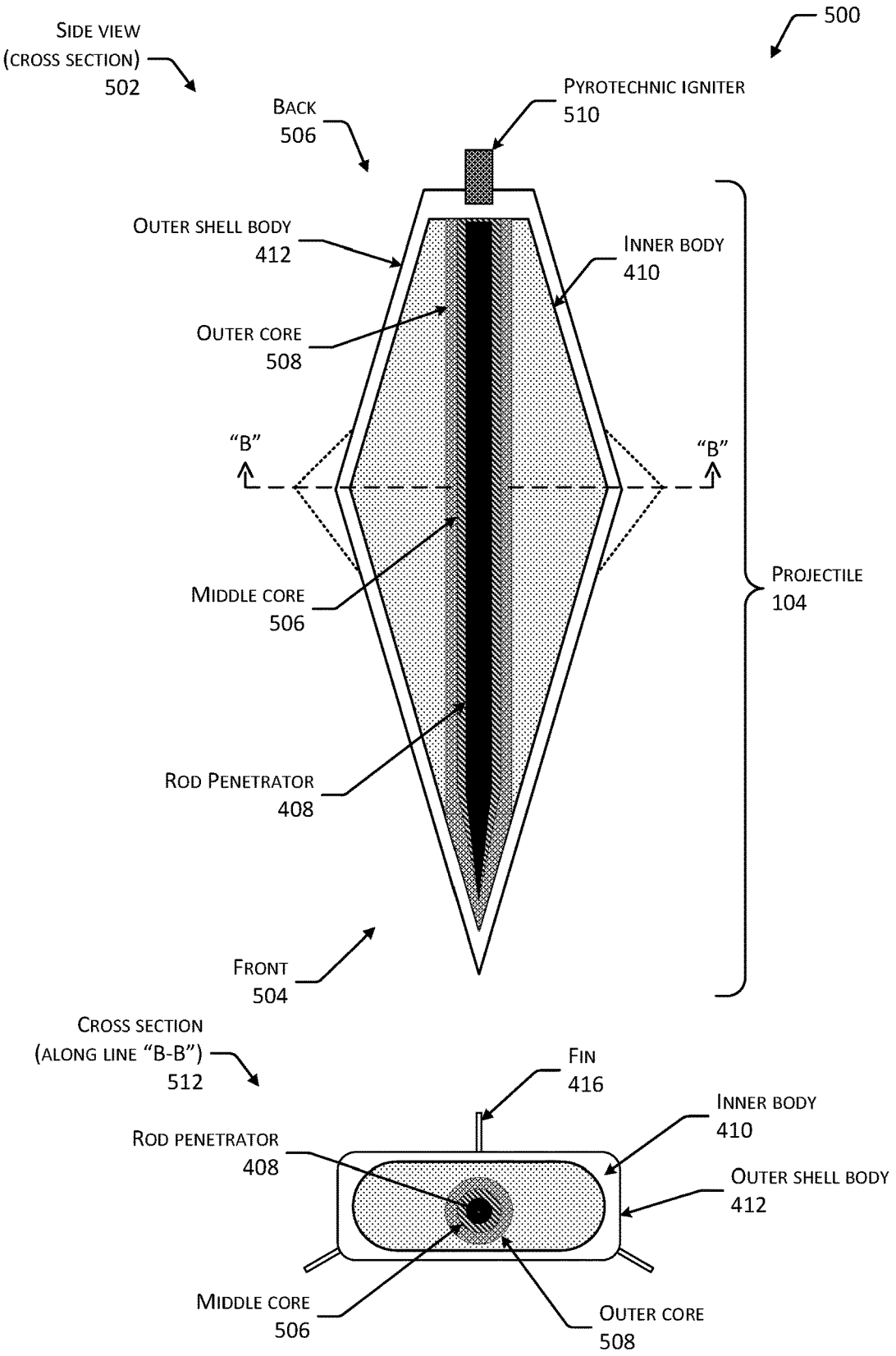
FIG. 5 illustrates a projectile configured with an abrasive inner core configured to provide abrasion of the material upon and subsequent to impact.

FIG. 5 illustrates two views 500 of another implementation of a projectile 104 design. As shown in a side view 502 showing a cross section, the projectile 104 may include a front 504 and a back 506.

The interior of the projectile 104 may also include a rod penetrator 408. While the penetrator is depicted as a rod, in other implementations the penetrator may have one or more other shapes, such as a prismatic solid.

The projectile 104 may include a middle core 506 and an outer core 508. In other implementations one or both of the middle core 506 and the outer core 508 may be omitted. The projectile 104 may also include an inner body 410 and an outer shell body 412. The inner body 410 and outer shell body 412 may have various shapes. For example, FIG. 5 depicts the inner body 410 and the outer shell body 412 having shapes different from those depicted in FIG. 4.

In some implementations, the projectile 104 may include a pyrotechnic igniter 510. The pyrotechnic igniter 510 may be configured to initiate, maintain, or otherwise support combustion of one or more combustible gas mixtures 130 during acceleration of the projectile 104.

Cross section 512 illustrates a view along the plane indicated by line B-B in the side view 502. As shown in FIG. 5, in some cases, the projectile 104 may not be radially symmetrical. In some implementations, the shape of the projectile 104 may be configured to provide guidance or direction to the projectile 104. For example, the projectile 104 may have a wedge or chisel shape. The projectile 104 may also include one or more fins 416, rails, or other guidance features.

The projectile 104 may comprise one or more abrasive materials. The abrasive materials may be arranged within or on the projectile 104 and configured to provide an abrasive action upon impact with the working face of the geologic material 112. The abrasive materials may include diamond, garnet, silicon carbide, tungsten, or copper. For example, a middle core 506 may comprise an abrasive material that may be layered between the outer core 508 and the interior of the rod penetrator 408.

Figure 6:
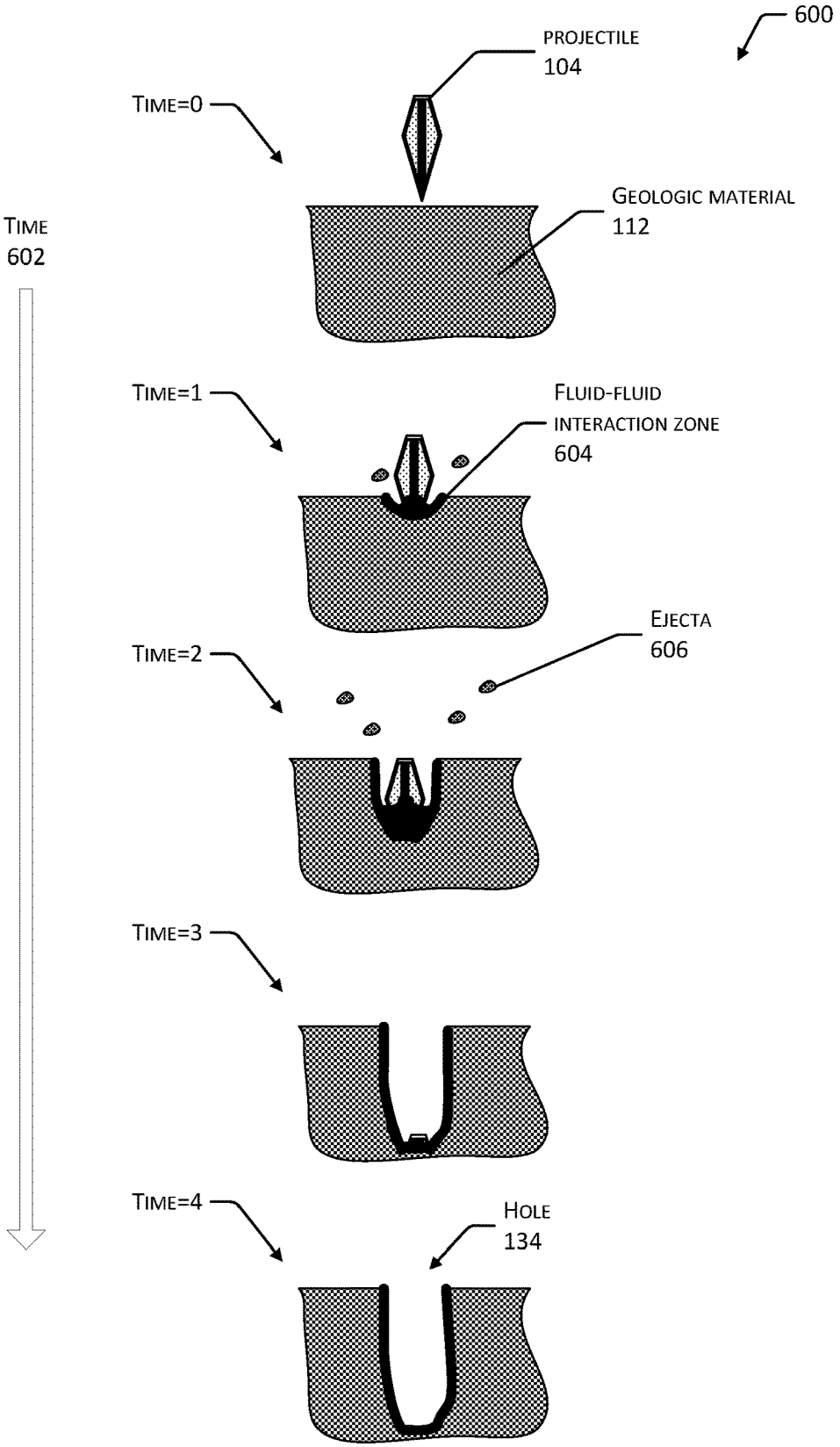
FIG. 6 illustrates a fluid-fluid impact interaction of the projectile with the geological material.

FIG. 6 illustrates a sequence 600 of interactions during a fluid-fluid impact between a projectile 104 and a geologic material 112. For example, such an interaction may occur during penetration of the working face of the geologic material 112 by a projectile 104 that is accelerated through a launch tube 106 to exit the lower end thereof toward the geologic material 112. In FIG. 6, the vertical arrow 602 indicates the passage of time, which increases toward the bottom of the page.

In one implementation, a projectile 104 having a length to diameter ratio of approximately 10:1 or more may be accelerated to a high velocity to impact the working surface of a geologic material 112. In some cases, an impact occurring at a velocity above approximately 800 meters/second may result in a penetration depth that is on the order of two or more times the length of the projectile 104. Additionally, the diameter of the hole 102 created may be approximately twice the diameter of the impacting projectile 104. A projectile 104 having a greater velocity may generate a hole 102 having a greater depth. As the velocity of the projectile 104 increases, the front of the projectile 104 may form a mushroom shape upon impact with the geologic material 112. This impact may produce a fluid-fluid interaction zone 604, which may result in erosion or vaporization of the projectile 104. A back pressure resulting from the impact may propel ejecta 606 or other material, such as cuttings from a drill bit 108 or other reamers, from the hole 102. The ejecta 606 may include particles of various sizes ranging from a fine dust to chunks. In some implementations, the ejecta 606 may include one or more materials which are useful in other industrial processes. For example, ejecta 606 that includes carbon may comprise buckyballs or nanoparticles suitable for other applications such as medicine, chemical engineering, printing, and so forth.

In some implementations, very little or no material of the projectile 104 may remain after impact, due to the projectile 104 and a portion of the geologic material 112 being vaporized due to the fluid-fluid interaction of the high velocity impact. Generally, a greater velocity of the impact will result in a more complete erosion of the projectile 104, which may result in the generation of an emptier hole 102 having a greater length and larger diameter.

Figure 7:
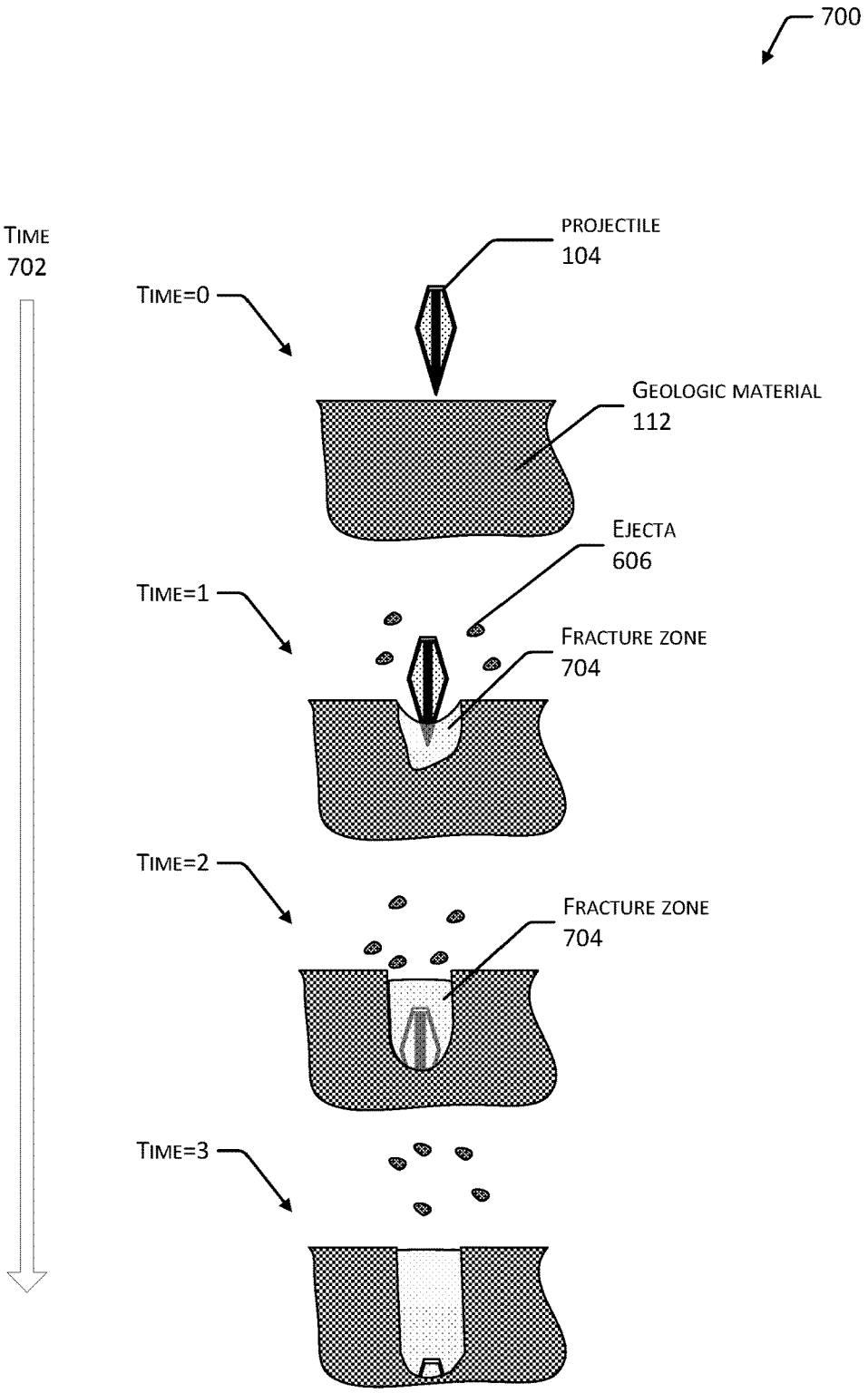
FIG. 7 illustrates a non-fluid-fluid impact interaction of the projectile with the geological material.

FIG. 7 illustrates a sequence 700 of interactions during a non-fluid-fluid interaction between a projectile 104 and geologic material 112, which may occur during penetration of the working face of the geologic material 112 by a projectile 104 having a lower velocity than the projectile 104 depicted in FIG. 6. In FIG. 7, the vertical arrow 702 indicates the passage of time, which increases toward the bottom of the page.

For example, when a projectile 104 exits the launch tube 106 at a velocity below 2 kilometers per second, the portion of the geologic material 112 impacted by the projectile 104 may fracture, as illustrated in FIG. 7, which shows a fracture zone 704. Ejecta 606 may be urged away from the impact site. In a non-fluid-fluid interaction, pieces of the projectile 104 or geologic material 112 may be pulverized or fractured, rather than vaporized. As described above, a back pressure resulting from the impact may urge the ejecta 606 from the hole 102.

Figure 8:
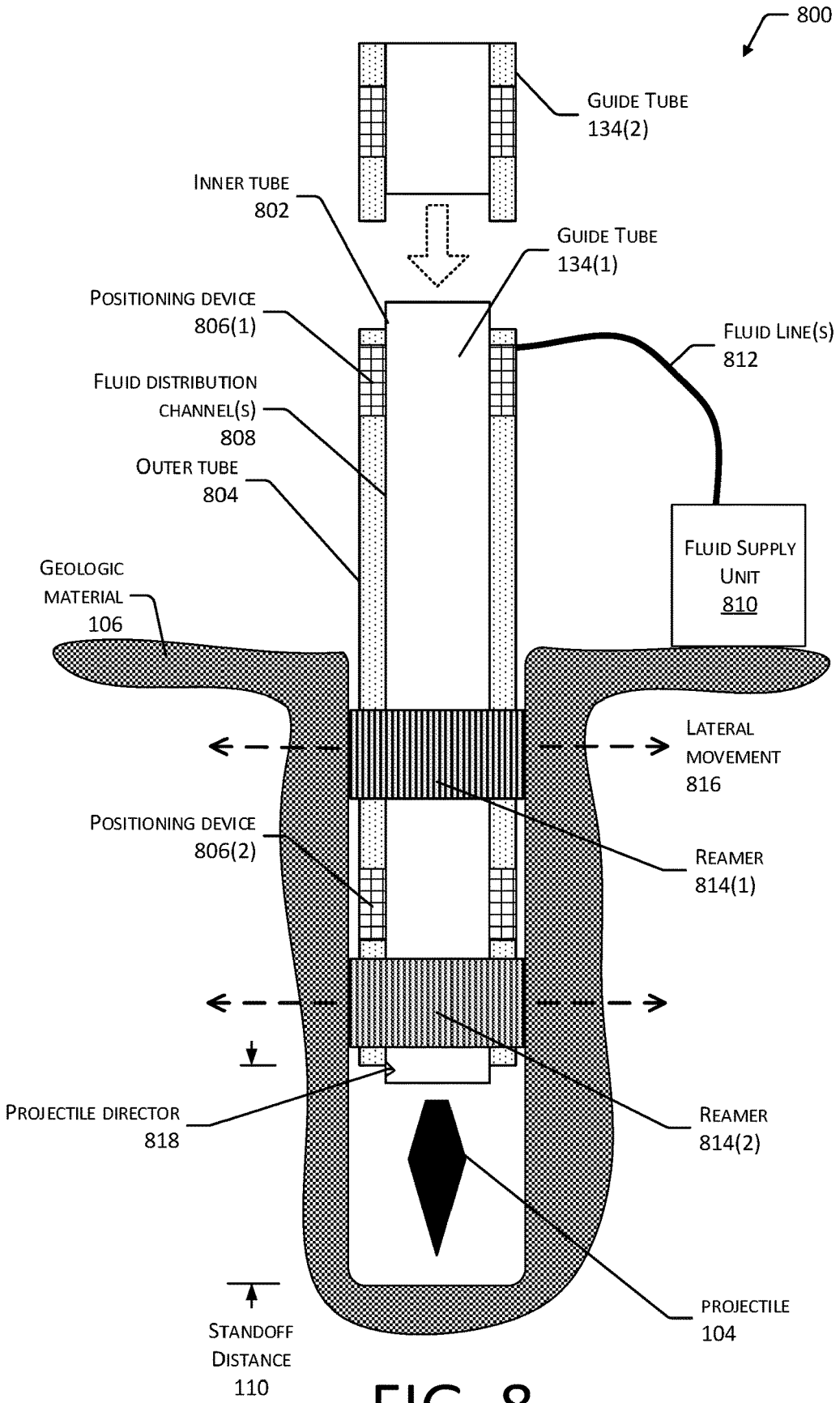
FIG. 8 illustrates additional detail associated with the guide tube, as well as reamers and other devices which may be placed down hole.

FIG. 8 illustrates a mechanism 800 in which a guide tube 134 may include an inner tube 802 and an outer tube 804. The position of the inner tube 802 relative to the outer tube 804 may be maintained by one or more positioning devices 806. In some implementations, the positioning device(s) 806 may include a collar or ring. The positioning device(s) 806 may include one or more apertures or pathways to allow passage of materials such as fluid, ejecta 606, and so forth. In some implementations, the positioning device(s) 806 may be configured to allow for relative movement between the inner tube 802 and the outer tube 804, such as rotation, translation, and so forth.

The space between the inner tube 802 and the outer tube 804 may form one or more fluid distribution channels 808. The fluid distribution channels 808 may be used to transport ejecta 606, fluids such as cooling or hydraulic fluid, lining materials, and so forth. In some implementations, the fluid distribution channels 808 may accept fluid from a fluid supply unit 810 via one or more fluid lines 812. The fluid distribution channels 808 may include a coaxial arrangement of one tube within another, the jacket comprising the space between an inner tube 802 and an outer tube 804. The fluid may be recirculated in a closed loop, or circulated in an open loop, such as for a single use.

In some implementations, the inner tube 802 and outer tube 804 may be collinear with one another. Additional tubes may be added, to provide for additional functionality, such as additional fluid distribution channels 808.

FIG. 8 also depicts one or more reamers 814, which may be coupled to the guide tube 134 and arranged in the hole 102. The reamer(s) 814 may be configured to provide various functions, such as cutting, scraping, or grinding the hole 102 to provide the hole 102 with a substantially uniform cross section. Additionally, the reamer(s) 814 may act as a bearing between the guide tube 134 and the walls of the hole 102. In some implementations, fluid from the fluid supply unit 810 may be configured to one or more of cool, lubricate, or power the reamer(s) 814. For example, a reamer 814 may couple to or communicate with a fluid distribution channel 808. The reamer(s) 814, or other supporting mechanisms such as rollers, guides, collars, and so forth, may be positioned along the guide tube 134, and may prevent or minimize Euler buckling of the guide tube 134 during operation.

In some implementations, one or more reamers 814 may be configured to produce one or more lateral movements 816, such as by use of one or more associated actuators or other mechanisms. These lateral movements 816 may displace at least a portion of the guide tube 134 relative to the wall of the hole 102, such as by, tilting, canting, or curving one or more portions of the guide tube 134. As a result, the point of impact of the projectile 104 may be shifted. By selectively applying lateral movements 816, the location of subsequent impacts of the projectile 104 within the geologic material 112 may be controlled and the resulting direction of the drilling path 138 may be altered. For example, the drilling path 138 may be curved as a result of the lateral movement 816.

In some implementations, a path of the projectile 104 may be altered by other mechanisms, such as a projectile director 818. A projectile director 818 may be arranged at one or more locations, such as within the guide tube 134, at an end of the guide tube 134 proximate to the working face of the geologic material 112, and so forth. The projectile director 818 may include a structure configured to deflect or shift the projectile 104 upon exit of the projectile 104 from the guide tube 134.

As described above, in some implementations, the guide tube 134 or launch tube 106 may be separated from the working face of the geologic material 112 by a standoff distance 110. The standoff distance 110 may vary based at least in part on depth, material in the hole 102, parameters of the accelerated projectile 104, and so forth. In some implementations, the standoff distance 110 may be two or more feet.

As drilling progresses, additional sections of guide tube 134 may be coupled to those which are in the hole 102. As shown in FIG. 8, the guide tube 134(1) which is in the hole 102 may be coupled to an additional section of guide tube 134(2). In some implementations, the inner tubes 802 and the outer tubes 804 may be joined in separate operations. For example, the inner tube 802(2) may be joined to the inner tube 802(1) in the hole 102, one or more positioning devices 806 may be placed, then the outer tube 804(2) may be joined to the outer tube 804(1).

Figure 9:
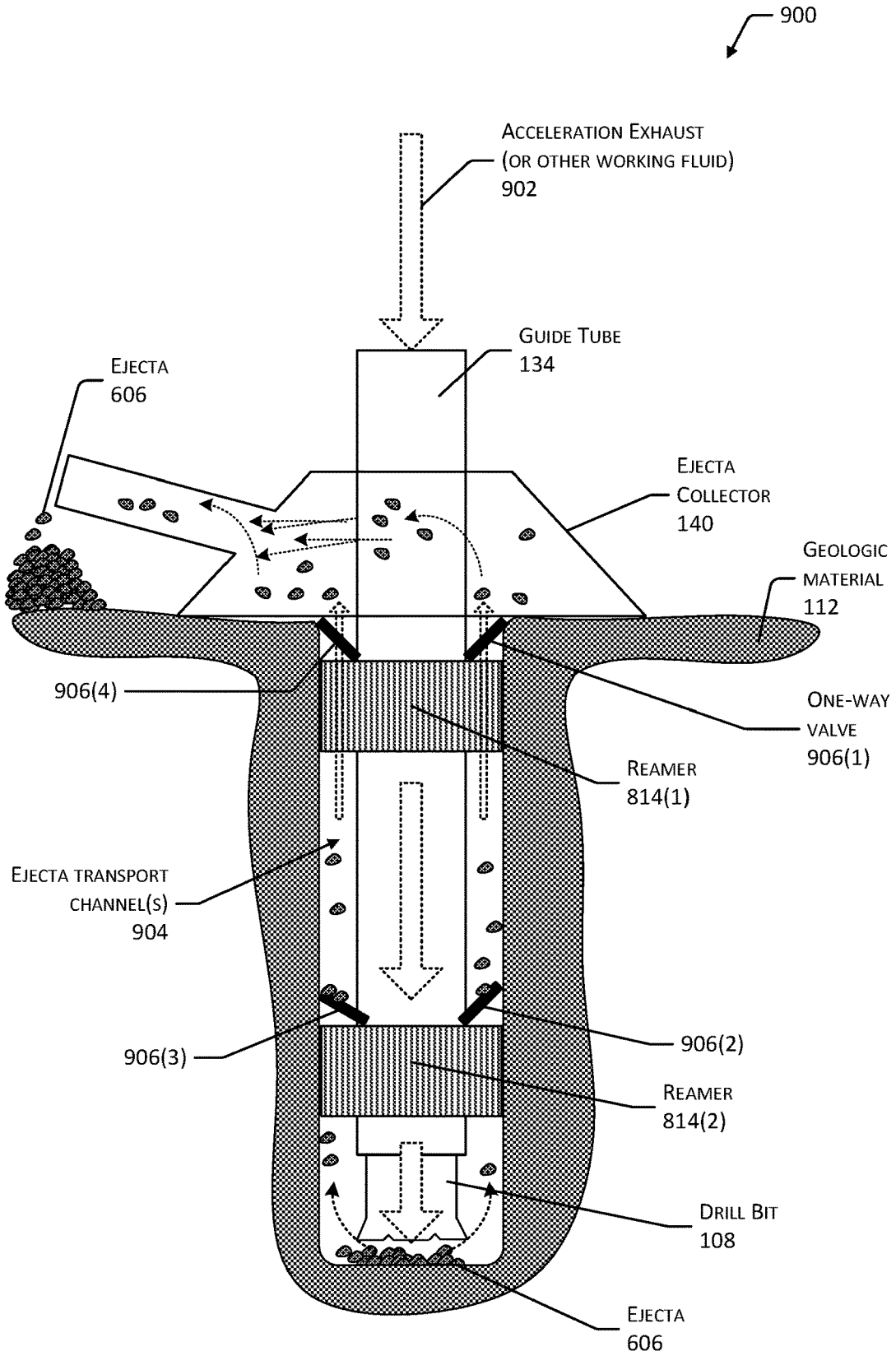
FIG. 9 illustrates a guide tube placed downhole having an ejecta collector coupled to one or more ejecta channels configured to convey ejecta from the impact aboveground for disposal.

FIG. 9 illustrates a mechanism 900 in which a fluid, such as exhaust from accelerating a projectile 104 through the launch tube 106 may be used to drive ejecta 606 or other material, such as cuttings from the reamers 814 or a drill bit 108, from the hole 102. The guide tube 134 may be engaged with a drill bit 108, one or more reamers 814, or both a drill bit 108 and one or more reamers 814. In some implementations, the fluid distribution channels 808 or other mechanisms, described with regard to FIG. 8, may be used in conjunction with the mechanism 900.

Acceleration exhaust 902 ("exhaust"), such as exhaust generated by the combustion of gasses or other combustible materials used to accelerate the projectile 104, or another working fluid, may be urged through the guide tube 134. The working fluid may include air or other gasses, water or other fluids, slurries, and so forth. In some implementations, the working fluid may be under pressure. The exhaust 902 may push ejecta 606 into one or more ejecta transport channels 904. In one implementation, the ejecta transport channels 904 may include a space between the guide tube 134 and the walls of the hole 102. In another implementation, the ejecta transport channels 904 may include a space between the guide tube 134 and another tube coaxial with the guide tube 134. The ejecta transport channels 904 may be used to transport ejecta 606 from the hole 102 to the ejecta collector 140.

In some implementations, one or more one-way valves 906 may be arranged within the ejecta transport channels 904. The one-way valves 906 may be configured such that the exhaust 902 and the ejecta 606 are able to migrate away from a distal end of the hole 102, toward the ejecta collector 140. For example, a pressure wave produced by the projectile 104 travelling down the guide tube 134 may force the ejecta 606 along the ejecta transport channels 904, past the one-way valves 906. As the pressure subsides, larger pieces of ejecta 606 may fall, but may be prevented from returning to the end of the hole 102 by the one-way valves 906. With each successive pressure wave resulting from the exhaust 902 of successive projectiles 104, or another working fluid, the pieces of ejecta 606 may migrate past successive one-way valves 906 to the surface. At the surface, the ejecta collector 140 may transport the ejecta 606 for disposal, storage, or another use.

The ejecta 606 at the surface may be analyzed to determine composition of the geologic material 112 in the hole 102. In some implementations, the projectile 104 may include a predetermined element or tracing material, such that analysis of ejecta 606 may be associated with one or more particular projectiles 104. For example, coded taggants may be injected into the exhaust 902, placed on or within the projectile 104, and so forth, and identification of particular taggants within ejecta 606 may enable the ejecta 606 to be associated with the particular exhaust 902 or projectile 104.

Figure 10:
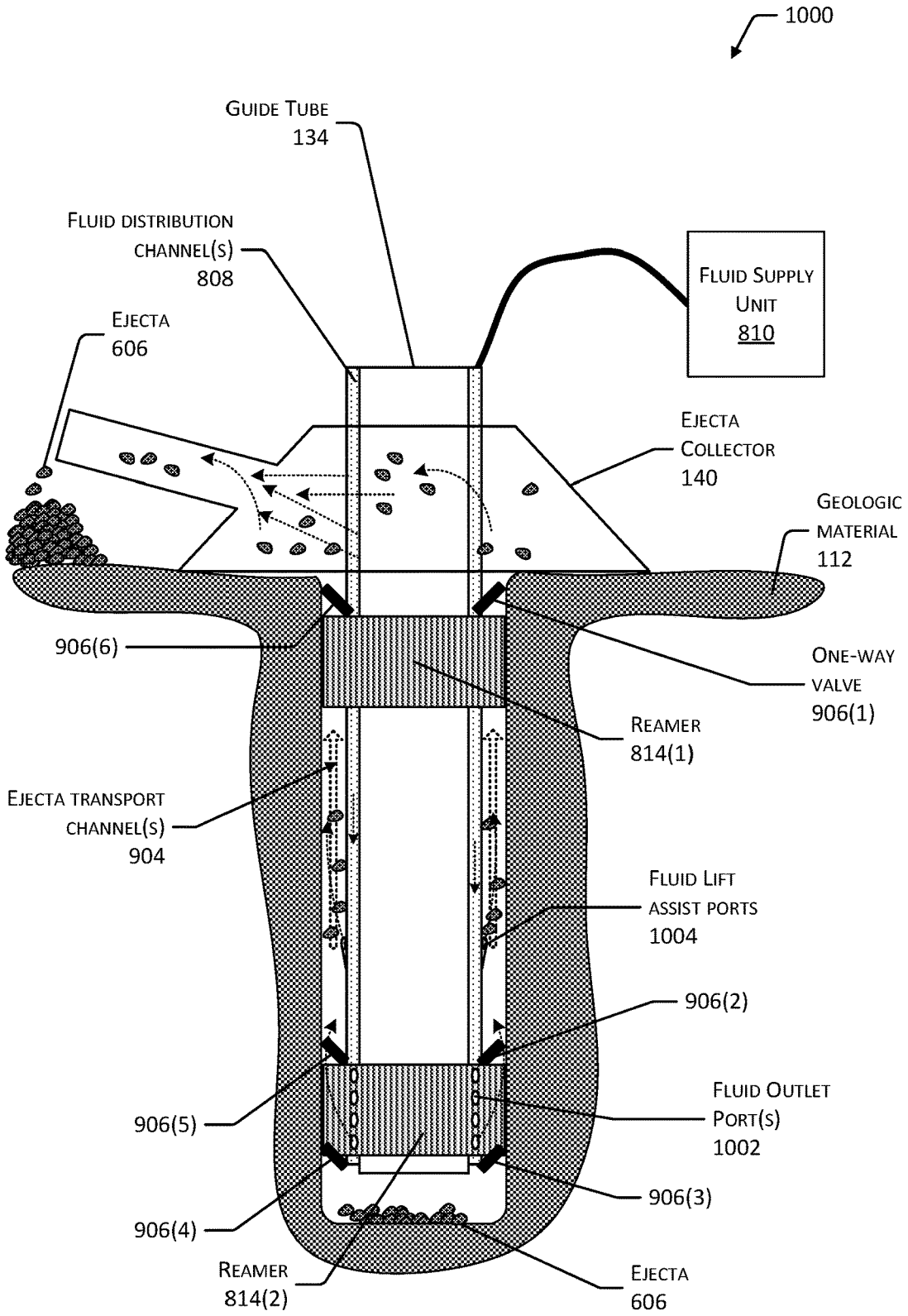
FIG. 10 illustrates a guide tube placed downhole having a reamer configured to be cooled by a fluid which is circulated aboveground to remove at least a portion of the ejecta.

FIG. 10 illustrates a mechanism 1000 for using fluid to operate reamers 814 or other devices in the hole 102 and to remove ejecta 606. As described above, the guide tube 134 may include one or more fluid distribution channels 808. The fluid distribution channels 808 may provide fluid from a fluid supply unit 810 to one or more devices or outlets in the hole 102.

FIG. 10 depicts a reamer 814 that includes one or more fluid outlet ports 1002. The fluid outlet ports 1002 may emit at least a portion of the fluid from the fluid distribution channels 808 into the hole 102. This fluid may transport ejecta 606 or other material, such as cuttings, away from the reamer 814. As described with regard to FIG. 9, in some implementations, a series of one-way valves 906 may facilitate travel of the ejecta 606 or other debris toward the ejecta collector 140. In other implementations, fluid lift assist ports 1004 may be arranged along the fluid distribution channels 808. The fluid lift assist ports 1004 may assist the movement of the ejecta 606 or other debris toward the ejecta collector 140 by providing a jet of pressurized fluid. The fluid outlet ports 1002, the fluid lift assist ports 1004, or both may be metered to provide a fixed or adjustable flow rate.

The movement of the fluid containing the ejecta 606 or other debris from the fluid outlet ports 1002 and the fluid lift assist ports 1004 may work in conjunction with pressure from the exhaust 902 to clear the hole 102 of ejecta 606 or other debris. In some implementations, various combinations of projectiles 104 may be used to facilitate clearing the hole 102 of debris prior to accelerating a particular projectile 104.

As described above, the acceleration of projectiles 104 may be performed in conjunction with other drilling techniques. For example, the end of the guide tube 134 in the hole 102 may be equipped with a cutting or guiding bit. For example, a coring bit may allow for core sampling. A concern when using existing rotary or impact/percussive drilling methods is well control. A weighted or pressurized drilling mud, which may be water-based, may contain carbon dioxide, petroleum, oil, or other liquids or gasses, may be used to provide pressure control against formation pressures (water, gas, oil, etc.). Drilling fluids may also be used for hole stabilization, friction reduction, and removal of ejecta 606.

Figure 11:
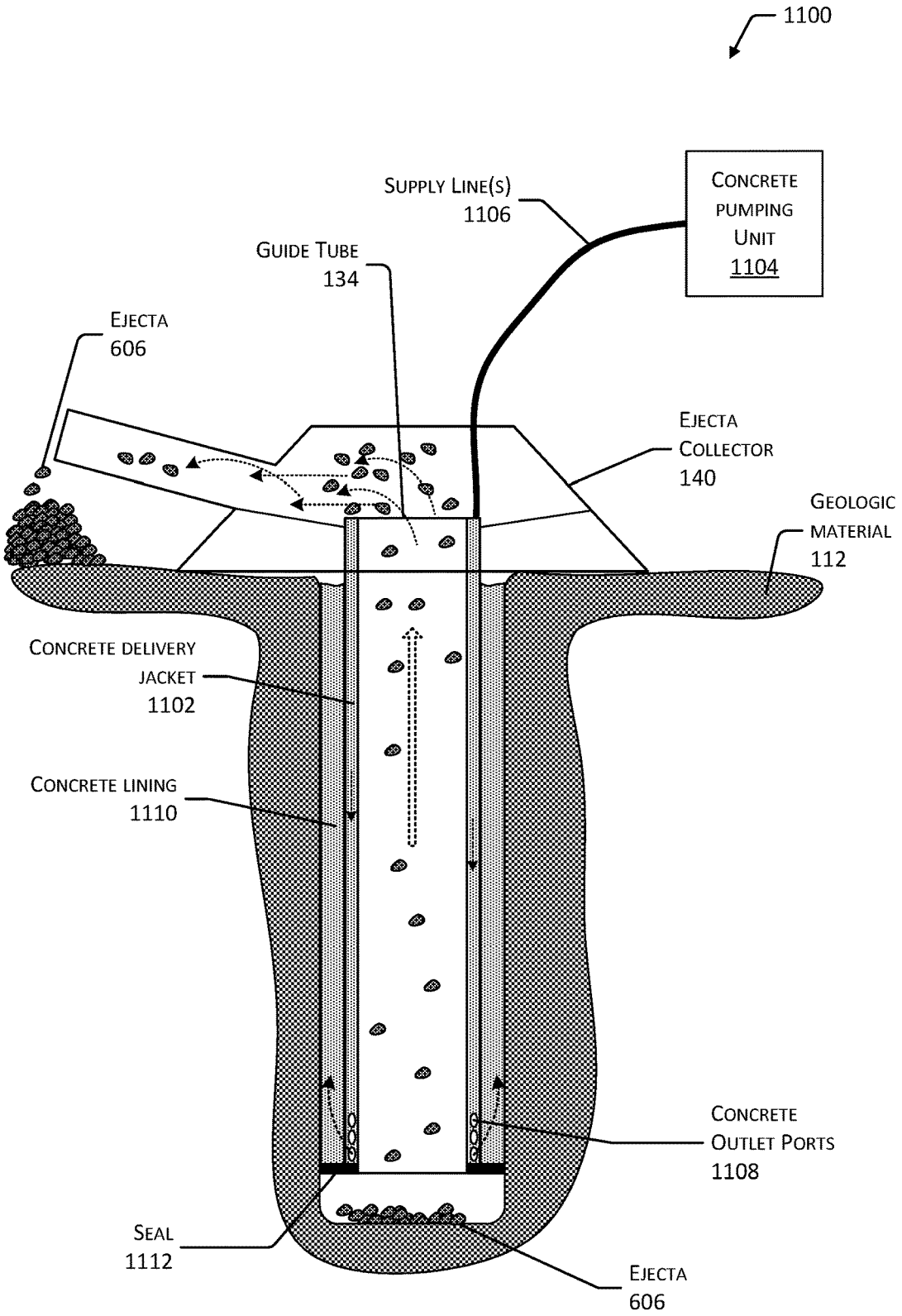
FIG. 11 illustrates a guide tube placed downhole deploying a continuous concrete lining within the hole.

FIG. 11 illustrates a mechanism 1100 in which a lining may be deployed within the hole 102. A concrete delivery jacket 1102 or other mechanism, such as piping, may be configured to accept concrete from a concrete pumping unit 1104 via one or more supply lines 1106. The concrete may flow through the concrete delivery jacket 1102 to one or more concrete outlet ports 1108 within the hole 102. The concrete may fill the space between the guide tube 134 and the walls of the hole 102. In other implementations, other materials such as Bentonite, agricultural straw, cotton, thickening agents such as guar gum, xanthan gum, and so forth may be used in place of or in addition to concrete.

As drilling continues, the guide tube 134 may be inserted further into the hole 102, and the concrete may continue to be pumped and extruded from the concrete outlet ports 1108, forming a concrete lining 1110. In other implementations, one or more materials other than concrete may be used to provide the lining of the hole 102.

In some implementations, a seal 1112 between the distal end of the hole 102 and the area containing the concrete lining 1110 may be used to minimize or prevent flow of concrete to the working face of the hole 102 where the accelerated projectiles 104 may impact. In one implementation, the concrete may include a release agent or lubricant. The release agent may be configured to ease motion of the guide tube 134 relative to the concrete lining 1110. In another implementation, a release agent may be emitted from another set of outlet ports. A mechanism may also be provided which is configured to deploy a disposable plastic layer between the guide tube 134 and the concrete lining 1110. This layer may be deployed as a liquid or a solid. For example, the plastic layer may comprise polytetrafluoroethylene ("PTFE"), polyethylene, and so forth. The mechanisms 1100 shown in FIG. 11 may be combined with the other mechanisms described herein, such as the reamer mechanisms 800, the ejecta 606 removal mechanisms 900 and 1000, and so forth.

Figure 12:
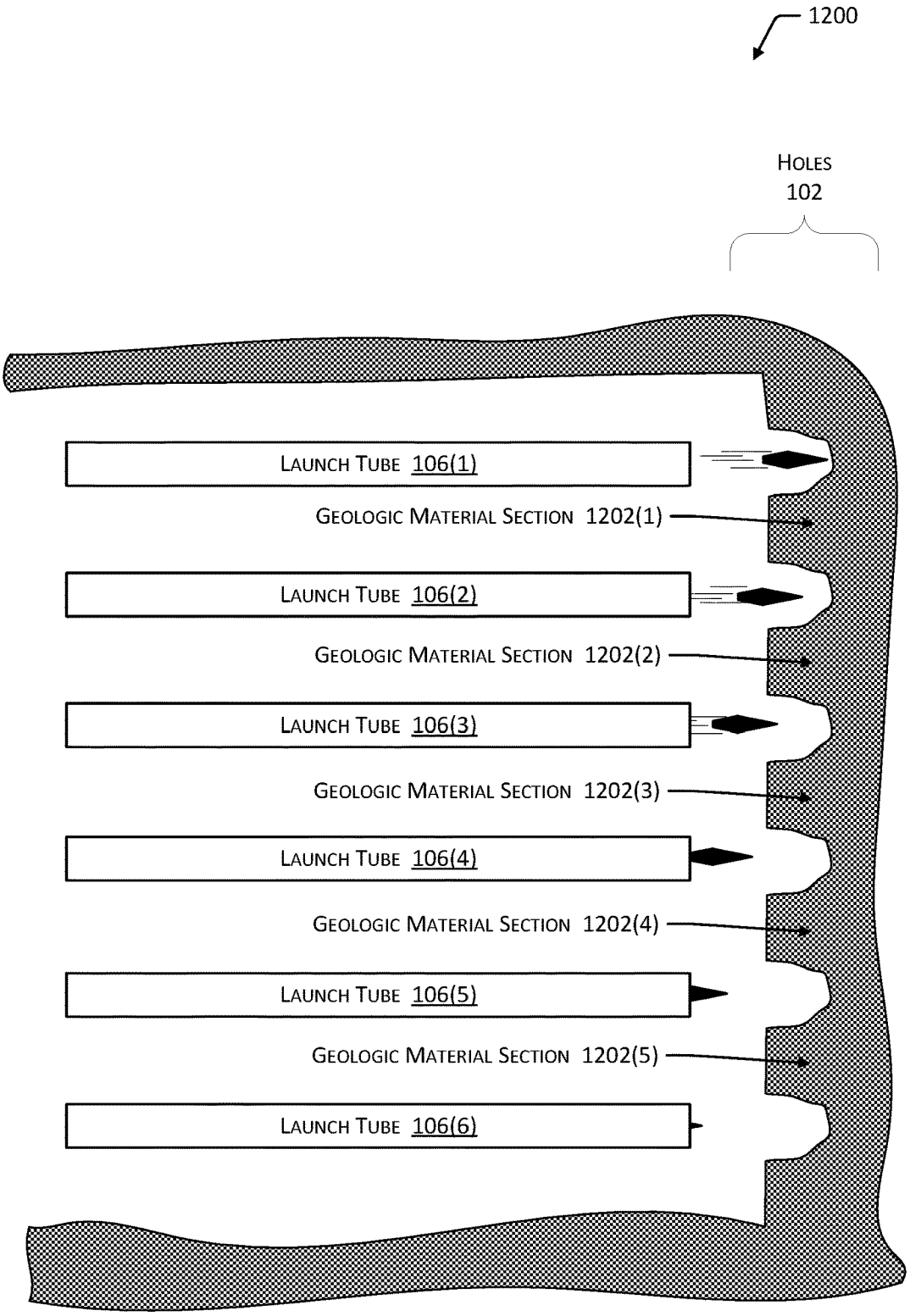
FIG. 12 illustrates tunnel boring or excavation using a ram accelerator to drill a plurality of holes using a plurality of projectiles.

FIG. 12 illustrates a mechanism 1200 for tunnel boring, excavation, or other operations using one or more accelerated projectiles 104. A plurality of launch tubes 106(1)-(N), which in some implementations may be a part of a larger ram accelerator assembly, may be fired sequentially or simultaneously to strike one or more target points on the working face, forming a plurality of holes 102. The impacts may occur in a predetermined pattern which generates one or more focused shock waves within the geologic material 112. These shock waves may be configured to break or displace portions of the geologic material 112 that are not vaporized by the impact with the projectile 104.

FIG. 12 depicts six launch tubes 106(1)-(6) arranged in front of the working face. One or more projectiles 104 may be accelerated through each of the launch tubes 106 to impact the working face and form corresponding holes 102(1)-(6). The plurality of launch tubes 106(1)-(N) may be moved in translation, rotation, or both, either as a group or independently, to target and generate the plurality of holes 102 in the working face of the geologic material 112. In another implementation, a single launch tube 106 may be moved in translation, rotation, or both, to target and drill the plurality of holes 102 in the working face of the geologic material 112.

After the holes 102 are formed using accelerated projectiles 104, various techniques may be used to remove geologic material sections 1202 or pieces. The geologic material sections 1202 may include portions of the geologic material 112 which are defined by two or more holes 102 that are proximate to one another. For example, four holes 102 arranged in a square may define a section of the geologic material 112 which may be removed, as described below with regard to FIG. 13.

As described above, use of one or more accelerated projectiles 104 may allow for rapid formation of the holes 102 in the geologic material 112, which may reduce the time and cost associated with tunnel boring or other operations.

Figure 13:
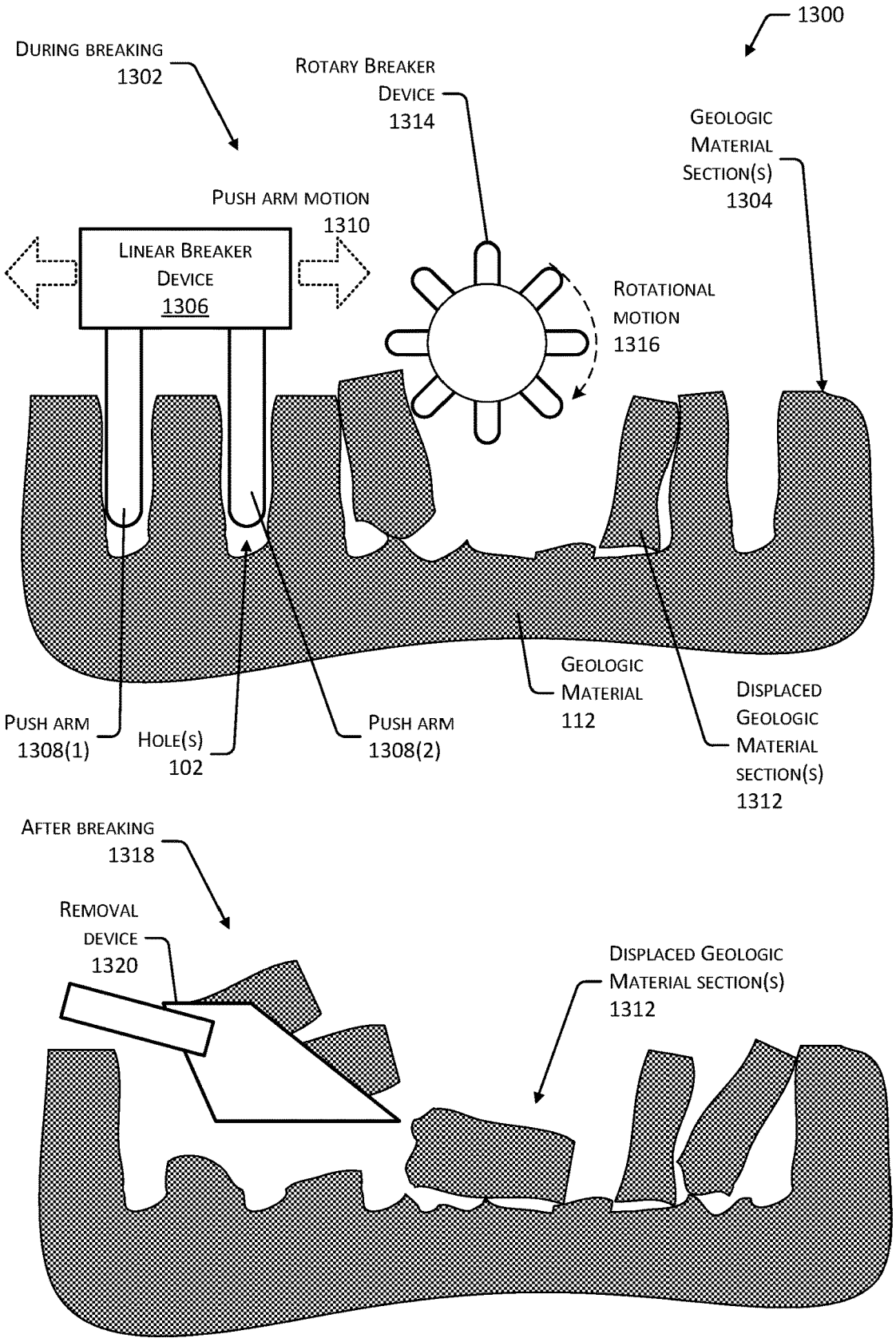
FIG. 13 illustrates devices to remove rock sections defined by holes drilled by the ram accelerator projectiles.

FIG. 13 illustrates devices and processes 1300 to remove rock sections defined by holes 102 generated using accelerated projectiles 104, such as the holes 102 described with regard to FIG. 12. In other implementations, the devices and processes 1300 of FIG. 13 may be used in conjunction with holes 102 formed using other drilling techniques. During breaking 1302, a mechanism may be used to break apart the geologic material sections 1304. In some implementations, the mechanism may be associated with the launch tube 106. For example, a launch tube 106 may include a linear breaker device 1306 that includes one or more push-arms 1308 that move according to a push-arm motion 1310. The push-arms 1308 may be inserted between the geologic material sections 1304, and mechanical force may be applied by push arms 1308 to snap, break, or otherwise free pieces of the geologic material 112 from a main body of the geologic material 112 at the working face, forming displaced geologic material sections 1312.

In some implementations, a rotary breaker device 1314 that moves according to rotational motion 1316 may be used instead of, or in addition to, the linear breaker device 1306. The rotary breaker device 1314 may break apart the geologic material sections 1304 by applying mechanical force during rotation. After breaking 1318, a removal device 1320 may transport the displaced geologic material sections 1312 from the hole 102. For example, the removal device 1320 may comprise a bucket loader.

Illustrative Processes

Figure 14:
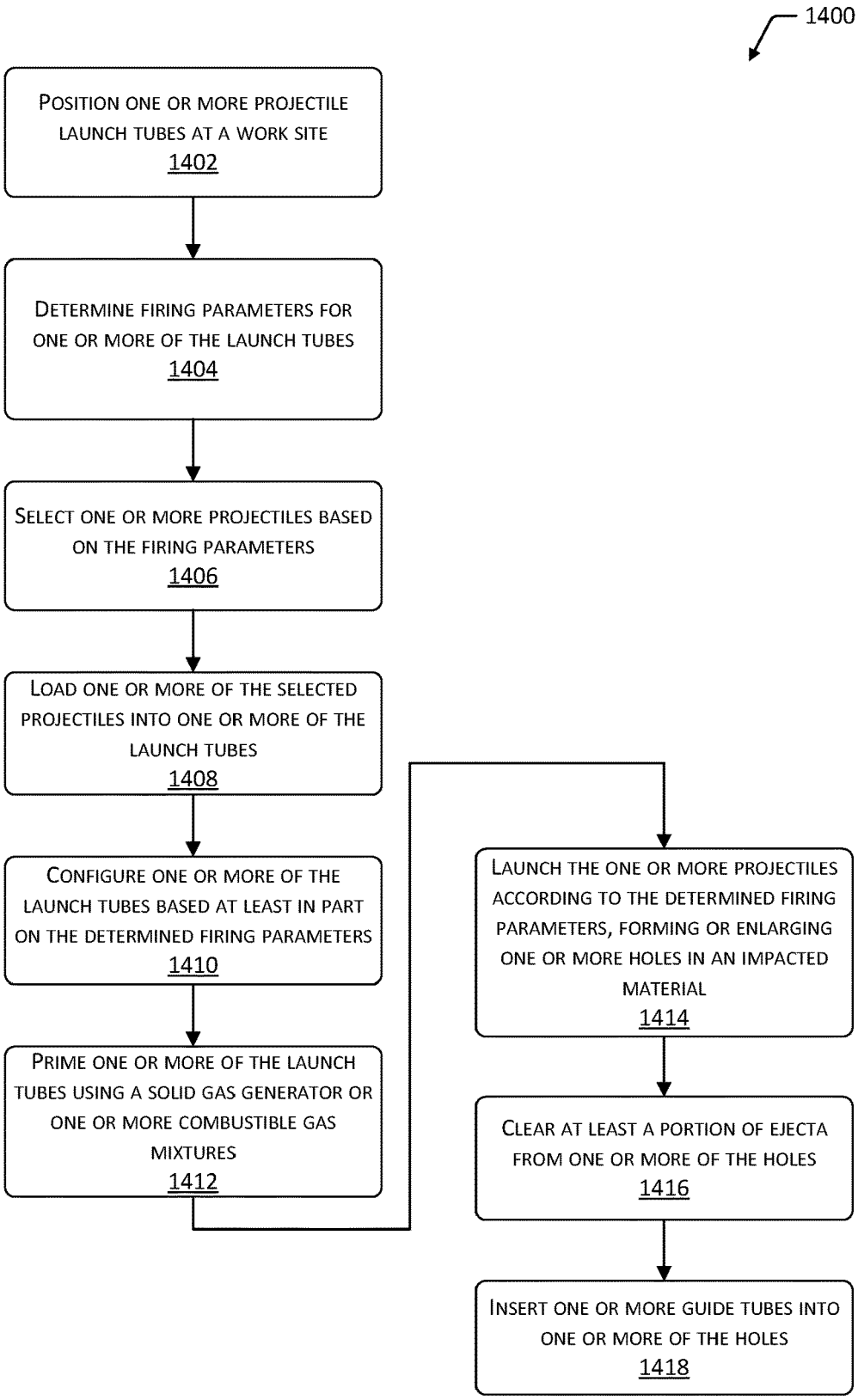
FIG. 14 is a flow diagram of a process of drilling a hole using a ram accelerator.

FIG. 14 is flow diagram 1400 illustrating a process for penetrating geologic material 112 using accelerated projectiles 104. At block 1402, one or more launch tubes 106 may be positioned at a work site 202 to facilitate the generation of one or more holes 102 for tunnel boring, excavation, and so forth. The launch tubes 106 may be oriented vertically, horizontally, or diagonally, and in some cases, may be positioned at a stand-off distance 110 from the working face of the geologic material 112 to be penetrated.

At block 1404, once the launch tubes 106 are positioned, one or more firing parameters for each of the launch tubes 106 may be determined. Firing parameters may include one or more of the type and composition of the projectile 104 to be used, the hardness and density of the geologic material 112, the characteristics and position or orientation of the launch tube 106, the ambient temperature, pressure, other ambient conditions, and so forth. At block 1406, one or more projectiles 104 may be selected based at least in part on the firing parameters. At block 1408, the selected projectile(s) 104 may be loaded into the launch tube(s) 106.

At block 1410, one or more of the launch tubes 106 may be configured based at least in part on the determined firing parameters. At block 1412, one or more of the launch tubes 106 may be primed, such as by using a solid gas generator or one or more combustible gas mixtures 130. After priming the launch tube(s) 106, block 1414 launches one or more of the loaded projectiles 104 according to the determined firing parameters. For example, a projectile 104 may be accelerated to a predetermined velocity, such as a ram velocity, when traveling through a launch tube 106, to impact and form or enlarge one or more holes 102 in the working face of the geologic material 112.

As described above, a back pressure resulting from the impact may force the ejecta 606 from the hole 102. In some implementations, at block 1416, a working fluid, such as compressed air, water, and so forth may be injected into the hole 102 to aid in removal of at least a portion of the ejecta 606. One or more of the holes 102 formed by the impact of a projectile 104 may be further processed. At block, 1418, a guide tube 134 may be inserted into one or more of the holes 102 to prevent subsidence, deploy instrumentation, and so forth. In one implementation, a reamer 814 coupled to a guide tube 134 may be inserted down the hole 102 and to provide the hole 102 with a substantially uniform cross section.

Figure 15:
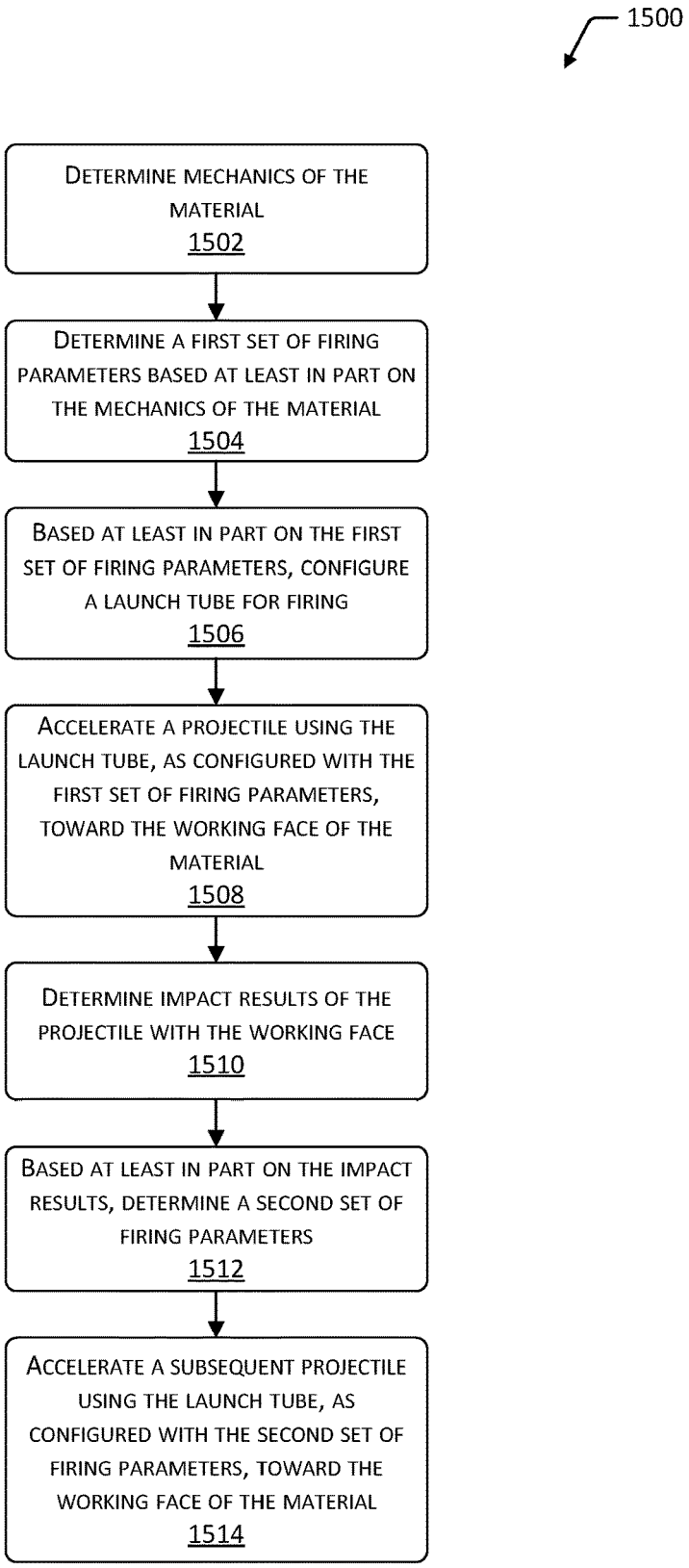
FIG. 15 is a flow diagram of a process of multiple firings of a plurality of projectiles with firing patterns adjusted between at least some of the firings.

FIG. 15 is a flow diagram 1500 illustrating a process for penetrating geologic material 112 using one or more accelerated projectiles 104 that are directed into a hole 102. At block 1502, the mechanics (e.g., properties) of the geologic material 112 may be determined. At block 1504, a first set of firing parameters for a launch tube 106 may be determined based at least in part on the mechanics of the geologic material 112. At block 1506, the launch tube 106 may be configured for firing based at least in part on the first set of firing parameters. At block 1508, a projectile 104 may be accelerated through the launch tube 106 to impact the working face of the geologic material 112, forming one or more holes 102. At block 1510, the impact results of the projectile 104 with the working face may be determined. In some embodiments, the launch tube 106 may be reconfigured before loading and accelerating a subsequent projectile 104 into the hole 102. At block 1512, a second set of firing parameters for the launch tube 106 may be determined based at least in part on the impact results. At block 1514, a subsequent projectile 104 may be accelerated using the launch tube 106, as configured with the second set of firing parameters, toward the working face of the geologic material 112. This process may be repeated until a desired penetration depth is reached.

Figure 16:
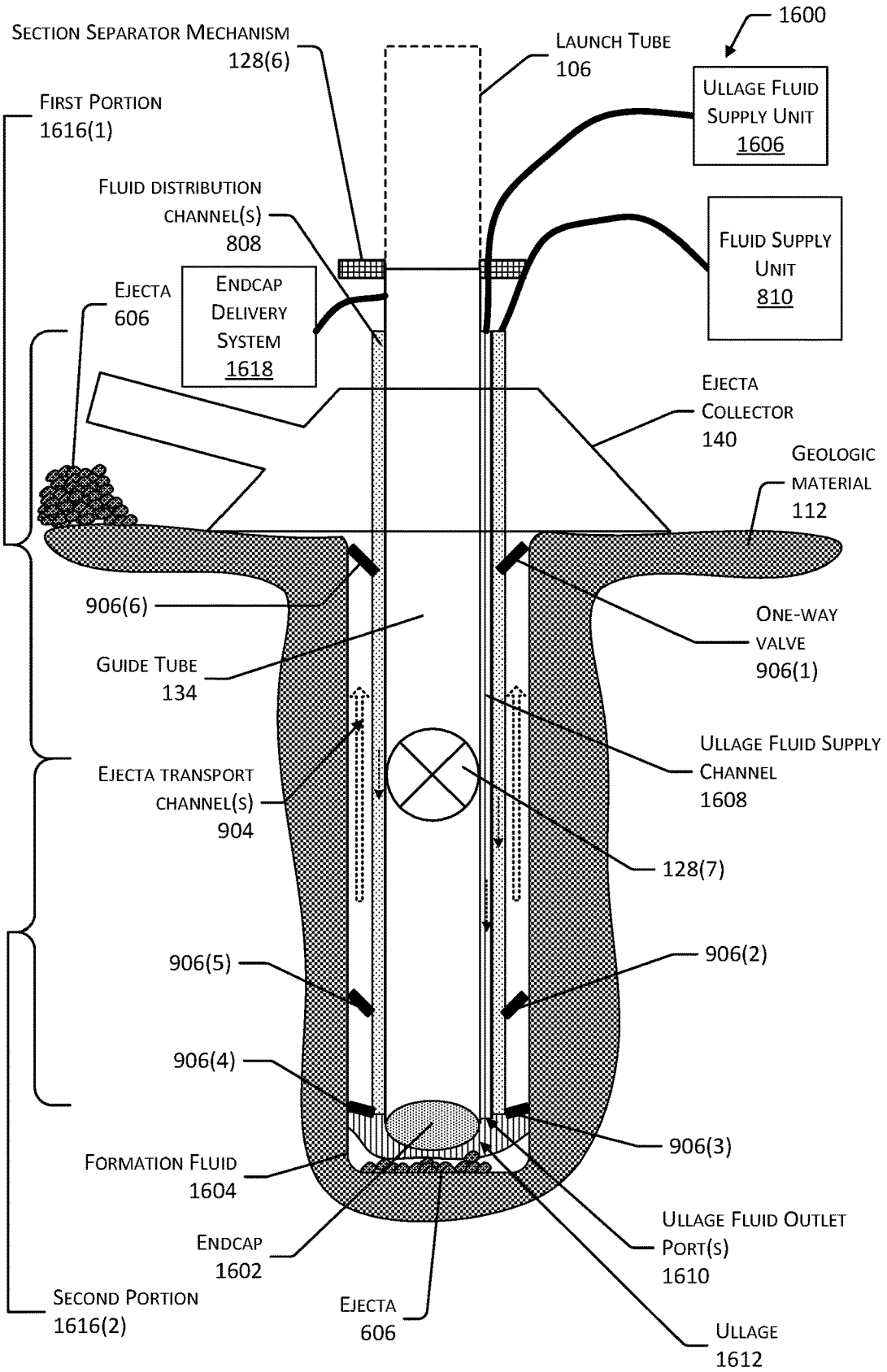
FIG. 16 illustrates a guide tube placed downhole with an endcap deployed and a system for creating an ullage in formation fluid in the hole.

FIG. 16 illustrates a mechanism 1600 that includes a guide tube 134 placed downhole with an endcap 1602 deployed at the lower end thereof. While FIG. 16 depicts a guide tube 134 positioned within a hole 102, in other implementations the mechanisms 1600 described may be used in conjunction with a drift tube or another tube. An endcap 1602 may be placed within the guide tube 134 to provide at least a partial seal between an interior of the guide tube 134 through which a projectile 104 may pass and a formation fluid 1604 which may accumulate at the working face within the hole 102. For example, the formation fluid 1604 may include drilling mud, oil, water, mud, gas, and so forth.

In one implementation, the endcap 1602 may be deployed to an end of the guide tube 134 which is proximate to the working face. The endcap 1602 may form at least a partial seal, preventing or impeding flow of the formation fluid 1604 into the portion of the guide tube 134 within which one or more projectiles 104 may travel.

In some implementations, an ullage fluid supply unit 1606 may provide an ullage fluid or purge gas by way of one or more ullage fluid supply channels 1608 to one or more ullage fluid outlet ports 1610 proximate to the working face. The ullage fluid may include a gas or a liquid. Gas ullage fluids may include, but are not limited to, helium, hydrogen carbon dioxide, nitrogen, and so forth. In some implementations, the ullage fluid may be combustible or detonable, such as a combustible gas mixture 130.

The ullage fluid may be injected into a volume which is bounded at least in part by the endcap 1602 and the working face. The ullage fluid may be applied at a pressure which is equal to or greater than the pressure of the surrounding formation fluid 1604. The ullage fluid may form an ullage 1612, or pocket, within the formation fluid 1604. For example, an ullage fluid that includes a gas may form an ullage 1612 defined by the space occupied by the gas. The ullage 1612 may displace at least some of the formation fluid 1604. This displacement may reduce or prevent the incursion of the formation fluid 1604 or components thereof within the hole 102. In some implementations, the ullage 1612 may include a pocket that occupies substantially the entire volume between the proximate portion of the drilling equipment and the working face, or a portion thereof. The ullage 1612 may provide a compressible volume within which pieces of ejecta 606 or other impact products may be dispersed.

In one implementation, the ullage fluid may be applied in a transient or "burp" mode, in which the ullage 1612 is present for a brief period of time. While the ullage 1612 is present, projectiles 104 may be accelerated through the endcap 1602, the ullage 1612, and into the working face.

In some implementations, the launch tube 106 may include a series of baffles or annular rings configured to control displacement of the combustible gas mixture 130 during passage of the projectile 104. The baffles or annular rings may be used instead of, or in addition to, the section separator mechanism 128 described above.

In one implementation, the endcap 1602 may provide the ullage 1612, displacing at least a portion of the formation fluid 1604. For example, the endcap 1602 may include a foam, expanded matrix, balloon, or other structure that may expand and maintain a seal with the guide tube 134. In some implementations, the endcap 1604 may include a combustible material. The endcap 1602 may be configured to come into contact with the working face, such as the ejecta 606, or may be separated from the working face by the formation fluid 1604 prior to creation of the ullage 1612.

In some implementations, a plurality of endcaps 1602 may be employed within the guide tube 134 or launch tube 106. For example, endcaps 1602 may be configured to perform one or more functions similar to, or the same as, the section separator mechanism 128.

In some implementations, instead of applying ullage fluid to create the ullage 1612, a chemical or pyrotechnic device may be used. For example, pyrotechnic gas generator charges may be deployed and configured to generate gas, forming the ullage 1612 in the formation fluid 1604. In another example, a chemical gas generator may be configured to emit a gas upon contact with a reactant, such as a component of the formation fluid 1604.

In other implementations, the projectile 104 may be configured to generate the ullage fluid. For example, the tip of the projectile 104 may be configured to vaporize and emit a gas, such that the ullage 1612 is formed.

The control system 144 may coordinate operation of one or more of the launch tube 106, the fluid supply unit 810, or the ullage fluid supply unit 1606. For example, the control system 144 may be configured to provide a surge or temporary increase in pressure to the fluid being distributed down the hole 102 prior to or during acceleration of a projectile 104. Similarly, the ullage fluid supply unit 1606 may be configured to provide the ullage fluid to form the ullage 1612 prior to impact of the projectile 104.

In some implementations, an auger or other mechanism may be provided to remove ejecta 606 from the volume proximate to the working face. For example, the end of the guide tube 134 may have one or more auger blades affixed such that rotation moves the ejecta 606 away from the working face and toward the ejecta transport channels 904.

The techniques described in this application may be used to drill holes 102 in geologic material 112 or other materials in terrestrial or non-terrestrial settings. For example, the system 100 as described may be used to drill holes 102 on Earth, on the Earth's Moon, on Mars, on asteroids, and so forth.

While FIGS. 1-16 depict and describe numerous example implementations of drilling methods in which a projectile 104 may be accelerated to penetrate geologic material 112, other means for accelerating the projectile 104 may also be used. For example, projectiles 104 may be accelerated to speed through a mass driver called a ram accelerator, such that the projectiles 104 exit the ram accelerator and impact the bottom of the hole 102, penetrating and eroding both the rock and the projectile 104 itself. A ram accelerator may include a start stage and a launch tube 106 (at vacuum or higher pressure). Passage of the projectile 104 through the ram accelerator may provide the projectile 104 with additional velocity through chemical energy. Other methods of propulsion may include detonation guns, light gas guns, two stage gas guns, electric rail guns, and laser or augmented laser propulsion and rocket propulsion systems.

Implementations described herein may be integrated within an existing tubular string, such as a drilling string in which drilling mud is provided to the bottom of a hole 102 and returned via the annulus. A launch tube 106 or other mechanism to accelerate projectiles 104 may be integrated within the drill string. The acceleration of projectiles 104 may include a semi-continuous operation, performed below the surface proximate to the working face of a hole 102, which may simplify and increase the safety of well control operations, and limit energy loss associated with long transits through tubular members.

In some implementations, in-situ propellants may be used. For example, propellants may be created via electrolysis or propellants and gasses may be entrained in drilling mud, enabling transport downhole without use of separate fluid conduits. In some implementations, solid or liquid propellants may be provided to a downhole environment. For example, some of the material of the projectile 104, itself, may include a fuel or propellant. In some cases, these techniques may simplify operation of the system by enabling operation of a drill rod or similar mechanism to provide energy to downhole elements. For example, rotational energy from a drill rod or similar mechanism may be converted into chemical energy for generation of a propellant, which may in turn be used to accelerate a projectile 104 to impact a target.

Use of a launch tube 106 to accelerate projectiles 104 may generate very little gas movement, and in some cases, combustion products, such as hydrogen, oxygen, or methane, may condense into the drilling mud proximate to the launch tube 106. The drilling mud may provide a barrier from the formation, and a head pressure of gasses within the launch tube 106, guide tube 134, or drift tube may function as a dynamic endcap that seals the tube without use of a physical mechanism or mechanical sealing required.

In some implementations, a loading and pumping mechanism located at the surface or above ground may be used to provide projectiles 104 through a tube into a downhole environment. For example, a projectile 104 may be more dense than drilling mud. The fluid motion and the weight of the projectile 104 may enable the projectile 104 to travel in a downhole direction. This may enable conventional well pressure control to be maintained using the weight and pressure of the mud and projectiles. In some implementations, the loading mechanism may include a top drive mechanism.

As described above, in some implementations, a projectile 104 may include a series of parts including a penetrator section and one or more separation stages to create barriers between stages, each stage associated with passage of the projectile 104 through a portion of the system. Additionally, a projectile 104 may also include one or more solid propellant, gas or liquid generator features. Upon a specific event (mechanical, electrical, pressure, etc.) the projectile 104 may release carried gasses into the accelerator mechanisms to provide working fluid (gasses) and to act as propellants or diluents.

In some cases, the drilling mud may contain one or more propellants or diluents, such as fuel, oxidizer, or propellant. Gasses or liquids may be encapsulated in small pellets or dissolved or suspended in the drilling mud. A mechanism may be used to separate the entrained propellants, diluents, and so forth. In some implementations, the hypervelocity impact may set off a mechanism for release and a mechanism for capture of the fluids/gasses that are desired for the acceleration process.

In some implementations, the drilling mud or another fluid may include microchips or radio frequency identification (RFID) chips suspended in the fluid, which may function as capsules that communicate with a downhole assembly having instrumentation and controls and down-hole logging equipment. The small electronic communication capsules may be able to communicate with one another or with devices used for surface data acquisition. In some cases, communication devices that span the length of a tubular string may form a communication network extending to the top of the rig that may allow complex high fidelity transmission of data down-hole.

In some implementations, a downhole energy generator may be used to generate energy for a drilling operation using accelerated projectiles 104. For example, an electrical generator may permit the passage of drilling mud, receive torque from a drill rod, and contact the walls of the hole 102, which may maintain torque in the generator while the drill rod is rotated.

Accelerated projectiles 104 may be used in industrial applications as well, such as in material production, fabrication, and so forth. In these applications, a target may comprise materials such as metal, plastic, wood, ceramic, and so forth. For example, during shipbuilding, large plates of high strength steel may have holes created therein for receiving piping, propeller shafts, hatches, and so forth. A launch tube 106 may be configured to fire one or more projectiles 104 through one or more pieces of metal to form the holes. Larger openings may be formed by generating a plurality of smaller holes around a periphery of the desired opening. Conventional cutting methods such as plasma torches, saws, and so forth may then be used to remove remaining material and finalize the opening for use. In addition to openings, the impact of the projectiles 104 may also be used to form other features such as recesses within the target. The use of accelerated projectiles 104 in these industrial applications may enable fabrication with materials that are difficult to cut, grind, or otherwise machine.

Furthermore, a projectile 104 may be configured such that during the impact, particular materials are deposited within the impact region. For example, the projectile 104 may include carbon such that, upon impact with the target, a diamond coating from the pressures of the impact are formed on the resulting surfaces of the opening. A backstop or other mechanism may be provided to catch ejecta 606, portions of the projectile 104 post-impact, and so forth. For example, accelerated projectiles 104 may be fired through the target material and toward a pool of water.

Further applications of the systems and techniques described herein may be used to launch projectiles 104 aerially. For example, a payload may be launched into a sub-orbital or orbital trajectory using the techniques described herein.

Those having ordinary skill in the art will readily recognize that certain steps or operations illustrated in the figures above can be eliminated, combined, subdivided, executed in parallel, or taken in an alternate order. Moreover, the methods described above may be implemented using one or more software programs for a computer system and are encoded in a computer-readable storage medium as instructions executable on one or more processors. Separate instances of these programs can be executed on or distributed across separate computer systems.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art and it is intended that the present disclosure encompass such changes and modifications that fall within the scope of the appended claims.

What is claimed is:

1. A method comprising:

providing a first end of a tube within a hole, wherein the tube has a longitudinal axis and the first end of the tube is engaged with a drill bit configured for cutting a surface of the hole positioned at a non-parallel angle relative to the longitudinal axis;

sealing the first end of the tube to isolate an interior of the tube from one or more materials within the hole;

providing a projectile within the interior of the tube;

providing a drilling fluid into the tube to one or more of actuate, lubricate, or cool the drill bit, wherein the drilling fluid includes a propellant material entrained therein;

using the propellant material to provide a force to the projectile, accelerate the projectile toward the first end of the tube, and pass the projectile through an orifice in the drill bit to exit the tube and impact the surface of the hole adjacent to the drill bit; and operating the drill bit during impact between the projectile and the surface such that the drill bit cuts the surface affected by impact with the projectile.

2. The method of claim 1, wherein the propellant material is one or more of dissolved or suspended in the drilling fluid.

3. The method of claim 1, wherein the propellant material includes one or more combustible gasses, the method further comprising igniting the one or more combustible gasses to generate the force.

4. The method of claim 1, further comprising:

orienting the tube at a non-parallel angle relative to a sidewall of the hole to accelerate the projectile in a direction that is non-parallel to the sidewall;

wherein the impact between the projectile and the surface of the hole extends the hole in the direction that is non-parallel to the sidewall.

5. The method of claim 1, wherein sealing the first end of the tube includes one or more of:

providing an endcap proximate to the first end of the tube;

closing a valve within the tube;

providing a diaphragm proximate to the first end of the tube; or providing a pressurized fluid proximate to the first end of the tube, wherein a pressure of the pressurized fluid is greater than or equal to a pressure of the one or more materials within the hole.

6. The method of claim 1, wherein at least a portion of the projectile includes at least a portion of the propellant material, the method further comprising providing a force to the projectile using a pressure generated by the propellant material.

7. The method of claim 1, further comprising:

generating at least a portion of the propellant material within the tube.

8. The method of claim 1, wherein sealing the first end of the tube includes providing one or more of an endcap, a closed valve, a diaphragm, or a fluid within the tube, and the projectile passes through the one or more of the endcap, the closed valve, the diaphragm, or the fluid to exit the tube.

9. The method of claim 1, wherein sealing the first end of the tube includes providing one or more of an endcap, a closed valve, a diaphragm, or a fluid within the tube, the method further comprising removing the one or more of the endcap, the closed valve, the diaphragm, or the fluid from a path of the projectile for the projectile to exit the tube.

10. A system comprising:

a tube having a first end, a second end, and an interior;

a seal proximate to the second end, wherein the seal prevents fluid communication between at least a portion of the interior of the tube and a region exterior to the tube;

a drill bit engaged with the second end, wherein the drill bit includes an orifice and is configured to cut a surface in front of the drill bit beyond the second end of the tube;

a projectile proximate to the first end; and a drilling fluid for one or more of actuating, lubricating, or cooling the drill bit, wherein the drilling fluid has a propellant material entrained therein to transport the propellant material within the tube and into association with the projectile, and the propellant material provides a force to the projectile to accelerate the projectile toward the first end to exit the tube, pass through the orifice in the drill bit, and impact the surface in front of the drill bit such that actuation of the drill bit cuts the surface affected by the projectile.

11. The system of claim 10, wherein the seal includes one or more of an endcap, a valve, a diaphragm, or a pressurized fluid having a pressure greater than or equal to a pressure external to the tube, and the projectile passes through the one or more of the endcap, the valve, the diaphragm, or the pressurized fluid to exit the tube and pass through the orifice in the drill bit.

12. The system of claim 10, wherein the propellant material includes one or more combustible gasses, the system further comprising an igniter proximate to the second end, the igniter configured to ignite the one or more combustible gasses to generate the force.

13. The system of claim 10, further comprising a device engaged with the tube and configured to move at least a portion of the tube in a lateral direction relative to a longitudinal axis of the tube to control a direction in which the projectile is accelerated.

14. The system of claim 10, wherein the seal includes one or more of an endcap, a valve, a diaphragm, or a pressurized fluid having a pressure greater than or equal to a pressure external to the tube, and the one or more of the endcap, the valve, the diaphragm, or the pressurized fluid is configured for removal from a path of the projectile for the projectile to exit the tube.

15. The system of claim 10, wherein the propellant material is one or more of dissolved or suspended in the drilling fluid, the system further comprising a mechanism that separates the propellant material from the drilling fluid.

16. A method comprising:

providing a tube having a first end and a second end into a hole, wherein a drill bit configured to cut a surface of the hole in front of the drill bit is engaged with the first end, the drill bit having an orifice;

sealing the tube proximate to the first end to at least partially prevent ingress of material from the hole into the tube;

providing a projectile proximate to the second end of the tube;

providing, into the tube, a drilling fluid to one or more of actuate, lubricate, or cool the drill bit, wherein the drilling fluid has a propellant material entrained therein;

actuating the propellant material to provide a force to the projectile to accelerate the projectile toward the first end of the tube to exit the tube and pass through the orifice of the drill bit to contact the surface of the hole; and operating the drill bit during contact between the projectile and the surface such that the drill bit cuts the surface affected by contact with the projectile.

17. The method of claim 16, further comprising orienting the tube at an angle that is non-parallel to a sidewall of the hole, wherein the projectile is accelerated in a direction that is non-parallel to the sidewall and the contact between the projectile and the surface of the hole extends the hole in the direction that is non-parallel to the sidewall.

18. The method of claim 16, further comprising generating at least a portion of the propellant material within the tube.

19. The method of claim 18, wherein generating the at least a portion of the propellant material within the tube includes generating the at least a portion of the propellant material using electrolysis.

20. The method of claim 16, wherein sealing the first end of the tube includes providing one or more of an endcap, a closed valve, a diaphragm, or a fluid within the tube, and the projectile passes through the one or more of the endcap, the closed valve, the diaphragm, or the fluid to exit the tube.

* * * * *